United States Patent [19]

Runkel et al.

[11] Patent Number: 4,609,344

[45] Date of Patent: Sep. 2, 1986

[54] YARN HEATING CHAMBER

[75] Inventors: Walter Runkel, Hückeswagen; Erich Lenk; Karl Bauer, both of Remscheid, all of Fed. Rep. of Germany

[73] Assignee: Barmag Barmer Maschinenfabrik AG, Remscheid, Fed. Rep. of Germany

[21] Appl. No.: 785,955

[22] Filed: Oct. 10, 1985

Related U.S. Application Data

[62] Division of Ser. No. 563,301, Dec. 19, 1983, Pat. No. 4,560,347.

[30] Foreign Application Priority Data

| | | | |
|---|---|---|---|
| Dec. 18, 1982 | [DE] | Fed. Rep. of Germany | 3247040 |
| Dec. 23, 1982 | [DE] | Fed. Rep. of Germany | 3247626 |
| Feb. 11, 1983 | [DE] | Fed. Rep. of Germany | 3304752 |
| Mar. 9, 1983 | [DE] | Fed. Rep. of Germany | 3308251 |
| Apr. 9, 1983 | [DE] | Fed. Rep. of Germany | 3312823 |
| May 21, 1983 | [DE] | Fed. Rep. of Germany | 3318645 |
| Jun. 11, 1983 | [DE] | Fed. Rep. of Germany | 3321202 |
| Jul. 22, 1983 | [DE] | Fed. Rep. of Germany | 3326432 |
| Oct. 15, 1983 | [DE] | Fed. Rep. of Germany | 3336101 |

[51] Int. Cl.[4] ..... F27B 9/28; F26B 13/00

[52] U.S. Cl. ..... 432/59; 34/160

[58] Field of Search ..... 432/8, 59; 34/160; 68/5 E

[56] References Cited

U.S. PATENT DOCUMENTS

| | | | |
|---|---|---|---|
| 2,228,272 | 1/1941 | Kinsella | 68/5 E |
| 2,351,110 | 6/1944 | Davidson et al. | 68/147 |
| 2,529,563 | 11/1950 | Miller | 68/212 |
| 2,708,843 | 5/1955 | Gibson et al. | 68/5 E |
| 2,954,687 | 10/1960 | Yazawa et al. | 68/5 E |
| 3,079,746 | 3/1963 | Field, Jr. | 57/328 |
| 3,278,430 | 1/1967 | Kodaira | 165/104.21 |
| 3,449,549 | 6/1968 | Isobe et al. | 432/8 |
| 3,796,538 | 3/1974 | Howorth | 432/9 |
| 4,100,660 | 7/1978 | Nemecek et al. | 68/5 E |
| 4,198,835 | 4/1980 | Luthi | 68/5 E |
| 4,226,092 | 10/1980 | Luthi | 62/374 |
| 4,398,386 | 8/1983 | Endo et al. | 57/288 |

FOREIGN PATENT DOCUMENTS

| | | |
|---|---|---|
| 2703991 | 8/1977 | Fed. Rep. of Germany . |
| 2840177 | 3/1980 | Fed. Rep. of Germany . |

*Primary Examiner*—John J. Camby

*Attorney, Agent, or Firm*—Bell, Seltzer, Park & Gibson

[57] ABSTRACT

A yarn heating chamber is disclosed which is adapted for thermally processing an advancing yarn. The chamber comprises first and second members each having a discontinuity in the form of a groove, shoulder or the like in a surface thereof, and the members are movably mounted with respect to each other between an operative position wherein the discontinuities are positioned relative to each other to define a relatively narrow yarn passage, and a threading position defining an enlarged opening to facilitate threading. Also, heating means is provided for introducing saturated water vapor into the yarn passage in the operative position, and the surfaces of the two members are in substantial heat exchange relation in both the operative and threading positions, so that the temperature of the two members remains substantially constant during a yarn threading operation. A heating duct system is disclosed which provides for the automatic shut-off of the saturated vapor upon movement of the members to the threading position, and condensate removal systems are disclosed.

9 Claims, 34 Drawing Figures

YARN HEATING CHAMBER

This application is a division of application Ser. No. 563,301, filed Dec. 19, 1983, now U.S. Pat. No. 4,560,347.

The present invention relates to a heating chamber for thermally processing advancing yarns, and which is adapted for treating a yarn with a pressurized and hot vapor, preferably with saturated water vapor or steam.

One problem associated with present yarn heating chambers of the described type is the fact that the heating vapor, being under an elevated pressure, escapes through the yarn inlet and the yarn outlet in such large quantities that the operation of the chamber is rendered uneconomical. To alleviate this problem, labyrinth seals and gap seals positioned at the yarn inlet and the yarn outlet are known. Labyrinth seals typically consist of a stack of discs positioned on top of each other with shutter-like openings, and form, upon relative movement of the plates, either a wide opening in the threading position, or a labyrinth opening in the operating position, note U.S. Pat. Nos. 4,100,660; 2,529,563; and 2,351,110. Labyrinth seals are suitable for the threading operation, but they are basically unsuitable in operation, since the necessity of an unhindered yarn travel cannot be achieved by reason of the winding or intricate outlet path which is necessary to avoid losses of the heating fluid. Gap seals are effective in that a long gap length provides a sufficient reduction of fluid loss. However, as the gap length increases and narrows, the threading operation becomes more difficult, particularly in the case of a pneumatic threading of the yarn.

Heating chambers for saturated water vapor are known in which the end areas of the heating chambers include a groove extending along the inside surface line, and which are sealed by plugs which are axially inserted into the end area, note for example German OS No. 27 03 991. In such known heating chambers, threading can be easily accomplished by removing the plugs from the end areas, but when the plugs are inserted, the yarn can be easily damaged since it does not travel in a defined location. Further, it is a significant disadvantage that during the threading operation the plugs cool to an extent such that a uniform operating condition after threading is reached only after some period of time, which results in a correspondingly high amount of waste yarn. Still further, the known heating chamber is costly to manufacture and difficult to operate.

It is accordingly an object of the present invention to provide a yarn heating chamber which provides for a rapid initial heating according to a steady and steep temperature curve over time, and which is characterized by stable temperature conditions which are substantially uneffected by a threading operation. The above advantage in turn serves to avoid local accumulations of condensate since it can be shown that the formation of condensate, for example in the form of droplets, becomes noticeable during substantial temperature changes, both during the heating and operation of the chamber.

These and other obJects and advantages of the present invention are achieved in accordance with the present invention by the provision of a heating chamber which comprises a first member which includes a surface having an elongate discontinuity therein, a second member which includes a surface having an elongate discontinuity therein, and with the surface of the first member being substantially congruent with the surface of the second member. The first and second members are mounted with the respective surfaces overlying each other and with the discontinuities being arranged generally parallel to each other, and so as to permit relative movement between an operative position wherein the discontinuities are positioned relative to each other to define a relatively narrow passage for the yarn, and a threading position wherein the discontinuities are positioned relative to each other to define an enlarged opening to facilitate thread-up of the yarn. Further, in each of the operative and threading positions, the surfaces of the first and second members are in substantial heat exchange contacting relation. The heating chamber further includes means for heating at least one of the first and second members, whereby the heating means acts to elevate the temperature of both of the first and second members to essentially the same temperature and so that a yarn passing through the yarn passage is thermally processed, and the temperature of the two members remains substantially the same during a yarn threading operation to provide for the uniform processing conditions for that portion of the yarn which is processed immediately after a yarn threading operation.

The heating means preferably includes a duct system for introducing a pressurized and saturated water vapor into the yarn passage when the first and second members are in the operative position. Also, the overlying surfaces of the two members are so adapted to each other that the heating vapor cannot escape, even under an elevated pressure, through the yarn passage formed between them. The discontinuities in the surfaces may take the form of a recess, groove, shoulder, or the like, which extends vertically or transversely to the direction of movement of the two surfaces, and which extends longitudinally in a straight line or a curve along the yarn path. In one embodiment, the surface discontinuity is covered in the operating position by the surface of the other member, so that in this position a narrow yarn guide passage is formed, which is sufficiently narrow to avoid undesirable pressure losses of the heating chamber, and which is so formed that a controlled pressure reduction and a controlled cooling of the yarn is provided along the passage. Where the surface discontinuity in one member is covered by the surface of the other member in the operative position, movement of the members to the threading position results in the discontinuity of the other member overlying the discontinuity of the first member, and forms therewith a suitably wide opening for axial threading, in particular for the pneumatic threading of the yarn. This discontinuity or groove of the second member serves only for threading, and preferably has a greater cross-section than the groove of the first member. Further, the groove of the second member preferably has an inclined flank on at least one side, which guides the yarn in a direction toward the yarn groove of the first member upon movement of the members to the operative position.

In another embodiment of the invention, the surface discontinuity of the second member is formed by the end edge of the mating surface, or as a slot in the closing surface of the second member, and which expose the yarn groove in a threading plane when the members are in the threading position, to thereby permit the threading of an advancing yarn transversely to its traveling direction. The surfaces may be flat or curved in the yarn traveling direction, and/or slightly curved transversely to the traveling direction of the yarn.

The mating surfaces of the two members need not necessarily lie in a common plane, when the members are designed as flat or curved plates. In particular, the surfaces can lie in two parallel planes, which intersect with the surface discontinuity in the form of a transverse shoulder in the surface of each member. The shoulders are of equal size, and in one embodiment, when the two members are in the operating position, the shoulders form a narrow passage. Depending upon the extent of the relative movement to the threading position, the shoulders form either a suitably widened opening for axial threading, or a yarn inserting slot for laterally threading an advancing yarn when the shoulder of one member projects beyond the edge of the other member.

In the operating position of the two members, the yarn heating chamber of the present invention can be adJusted to a narrow width of the yarn passage, in particular at the yarn inlet and/or yarn outlet, which measures, for example, 0.2 to 0.5 mm wide. This permits an advancing yarn to be guided without interference, and yet the losses of the heating vapor are low. The passage width, in particular in the yarn outlet area, can vary over the passage length. There may also be connected to the passage a pressure release or vacuum chamber, so as to obtain a controlled pressure gradient along the yarn path. This same purpose is achieved when the outlet passage is well insulated.

In another embodiment of the invention, the heating chamber comprises an elongate tubular member, with a pair of the above-described first and second members disposed at each end of the tubular member. More particularly, one of the members may be fixedly attached to a flange which is mounted at the end of the tubular member, and with the other member being relatively movable. In this embodiment, each pair of members is preferably designed as an outer member which is fixed to the end flange and which has a cylindrical bore, and the other member is a cylinder disposed coaxially in the bore of the sleeve. The outer member and cylinder are preferably threadedly interconnected, so that upon relative rotation, a simultaneous axial movement is achieved, which permits the end of the cylinder to sealingly engage the end flange. Further, in this embodiment the thread forms a labyrinth which provides an additional sealing effect in the operating position.

An advantage of the present invention resides in the fact that both the first and second members remain in substantial heat exchange contacting relation in both the operative position and the threading position, and therefore a stable operating condition is reached within moments after the completion of the operation. This advantage is particularly effective when the first and second members of the heating chamber extend over its entire length, and wherein the narrow yarn passage of the surface discontinuities is formed between the mating surfaces. With this arrangement, it is provided that the two members of the heating chamber keep essentially the same temperature even in the threading position, in that the temperature falls only slightly or not at all in the threading position and so that the operating temperature is fully effective immediately upon movement to the operating position. In this regard, it will be understood that since the members are not heated during thread-up, the temperature of the members may well decrease depending on how long the threading operation takes.

A two-part yarn heating chamber can also be provided with the present invention, by configuring the groove in the surface of one of the members to be of increased width along the medial portion of its length. This construction is useful by enabling a ballooning of the yarn and/or to avoid or reduce friction between the yarn and groove wall. In addition, the above construction permits the pressure of the heated saturated vapor to be substantially constant over the medial portion of the heating chamber. The medial portion can, for example, extend about 300 mm or less. With this arrangement, one of the members, preferably the stationary member, may be provided with a secondary or preheating duct, which is disposed in the member along a direction essentially parallel to the surface discontinuity, and which is supplied with the heated vapor. This preheating duct can include connecting lines to the yarn guide passage and thus be a part of the vapor supply system. The advantage of such a preheating duct is that it heats the member in which it is positioned. However, it is fully functional only when, according to the present invention, the other movable member remains in contact with the heated member in the threading position, and so that the heat is then also transferred to the movable member. Accordingly, the preheating duct results in a significant improvement of the heat conduct and a reliable behavior of the heating chamber during operation in accordance with the present invention.

The separation between the closing surfaces of the first and second members can be sealingly designed by both suitable manufacturing techniques and the application of a high clamping force, so that no substantial losses of the heating vapor result. Sealing by means of a sealing plate placed between the mating surfaces of the two members is not possible, since such a sealing plate would also provide an insulating effect and would therefore impede an equalization of the temperature between the two members. According to a preferred embodiment of the invention, two sealing strips are provided to seal the heating chamber, with the sealing strips extending along respective opposite sides of the yarn passage at a predetermined distance, for example 5 mm. Similarly, a sealing strip or other transverse seal can be provided at the inlet and outlet areas of the heating chamber, and which are disposed transversely to the yarn passage. In the absence of such sealing strips, the two members would necessarily have to be very firmly pressed against each other for the purpose of sealing the yarn duct. Such pressure is disadvantageous, however, since when the yarn passage is absolutely closed, the amount of heat which must be transferred between the two members would, aside from the possibility of a preheating duct, be exclusively transferred via the narrow yarn passage. In contrast thereto, the advantage of the use of sealing strips is that they create on both sides of the yarn passage a separation of a defined and predetermined area in which the hot vapor can penetrate without escaping. The surrounding surfaces on both sides of the yarn passage are thus heated at the same time. This measure, thus, also contributes to the uniform and rapid heating of the two members, and a consistent temperature during operation.

The heating chamber, and particularly the area of the mating surfaces, may be sealed by pneumatic pressure. For example, one of the members may receive on its back side the pressure of a gas on a defined area, either directly or by means of an elastic member under pressure. Pressure may also be applied by means of another medium, such as compressed air. Preferably, however, the pressure is applied by the pressurized and heated saturated vapor itself. For this purpose, one embodiment of the present invention provides that the back surface receiving the saturated vapor is in communication with the heating duct. Further, sealing strips may be provided on the back side which receives the saturated vapor, with the strips enclosing an area which is larger than the area defined between the sealing strips in the area of the yarn passage.

In addition to the advantages arising from the resulting contact pressure, the application of pressure to one of the members by means of the pressurized and heated saturated vapor is further beneficial in that at least one of the members forming the heating chamber, and preferably the one which is movable and does not include a preheating duct, is heated on its side opposite from its closing surface so that there is at most only a slight temperature gradient across the cross-section of this member.

It is a particular advantage of the heating chamber of the present invention that a yarn can be easily, rapidly, and reliably threaded, and that the sealing system and particularly the sealing strips and contact pressure of the members, effects a nearly complete seal. In addition, the easy thread-up makes it possible to provide for a very narrow gap-like end area, which is only limited by the yarn denier, and which may be of any desired length. Thus, the heated vapor is almost entirely prevented from escaping. Further, it is possible to obtain pressurization of the vapor at temperatures up to more than 200° C., as well as a steady increase of the vapor pressure from atmospheric to operating pressure and of the vapor temperature for the incoming yarn, and a steady decrease of the pressure to atmospheric pressure and of the temperature for the exiting yarn. The steady decrease of the pressure substantially eliminates the danger of a yarn damaging vapor current.

The width of the yarn passage formed by the surface discontinuities is adapted to the yarn denier. Further, the length in the end areas may extend from 100 to 300 mm, and is kept narrow so as to obtain a good sealing effect. By providing an appropriate width of the yarn passage, it is possible to guide several yarns in one yarn passage. Similarly, a member may have several surface discontinuities forming yarn passageways, it then being possible to guide one or several yarns in each passage. Thus the heating chamber of the present invention is also suited for heating a web of several yarns, for example in a drafting system processing a web of yarns.

It is also possible to align several yarn heating chambers of the present invention parallel to each other, and to interconnect the chambers to a common line for the heating vapor. This avoids to a substantial degree throttling losses between the yarn ducts, and insures a good consistency of the resulting yarn temperatures among the several heating chambers.

When heating above 100° C., the advantage of heat treating an advancing yarn, in particular a multifilament synthetic yarn, with saturated water vapor rather than a super-heated water vapor or hot air, resides in the fact that the saturated water vapor possesses a high latent heat content (heat of evaporation), and that a considerable heating of the yarn at high yarn speeds and short dwelling times is made possible due to the very high heat transfer coefficients at condensation, in contrast to convection, radiation or direct heat conduction. Further, the treatment with saturated water vapor also contributes to a uniform distribution of the temperature and a good temperature uniformity over the entire length of the treatment zone. Still further, the treatment zone may be randomly predetermined by the successive arrangement of several treatment chambers, since the required uniformity and constancy of the operating temperature for several treatment chambers can be insured by adjusting the pressure and by equalizing the pressure between the treatment chambers, while simultaneously removing inert portions. The losses at the inlet and outlet of the treatment zone can be kept low and lower than in comparable hot air heating zones by correspondingly designing the yarn inlet and yarn outlet openings.

For the above reasons, the treatment chambers with saturated vapor according to the present invention are particularly suitable in conjunction with the simple thread-up of the yarn provided by the invention, for the treatment of yarn in which a large amount of heat must be transferred to the yarn at a high yarn speed within a relatively short dwelling time, such as, for example, with synthetic fibers in spinning processes, spin draw processes, spin texturing or spin draw texturing processes and draw texturing, draw twisting, draw winding and other draw processes. Thus for example, it is possible to subject newly spun fibers, which are withdrawn at a high speed of, for example, more than 3,000 m/minute from the spinneret, to a saturated vapor treatment below the spin tower, for the purpose of tempering and/or (if necessary following an interposed draw point fixation, for example by a yarn brake) for the purpose of locally drawing the traveling yarn. Since temperatures above 100° C. and more than 200° C. can be obtained, it is also possible to influence the length of the treatment zone within a wide range.

In a continuous spin-draw process where drawing occurs between two draw rolls, the saturated vapor treatment chamber can advantageously be used for applying the draw temperature in a locally defined area between two draw roll systems, it being possible to heat the second draw roll system, normally referred to as draw godet, to about 120° C. According to this invention, the heating chamber can also serve for setting, tempering and/or the shrink treatment of a yarn after the actual draw process.

Since friction false twist apparatus for very high yarn speeds are now available (note U.S. Pat. No. 4,339,915), the saturated vapor yarn treatment chamber of the present invention can also be used to spin a yarn in a continuous process, in particular polyester or polyamide filament yarns, and to then directly subject the yarn (if necessary with an interposed draw zone or under simultaneous drawing) to a false twist treatment in the saturated vapor treatment zone.

Another advantage of the treatment with saturated water vapor resides in the fact that a saturated vapor treatment moistens the yarn as a result of the condensation of the vapor to water. Therefore, upon leaving the yarn heating chamber, water is rapidly evaporated due to the pressure drop, and the yarn is cooled to the boiling temperature of the water. Therefore, the saturated vapor treatment is suitable for all processes in which heating of the yarn and forced cooling directly follow each other. In particular, in the case of a false twist texturing process, a temperature gradient in the sense of a controlled cooling of the yarn is achieved according to the present invention by the design of the outlet opening and other above-mentioned measures, together with the controlled pressure release.

For the further cooling of a yarn to below 100° C., a yarn finishing liquid or water may be applied, for example, through a nozzle, following the evaporative cooling resulting from the evaporation of the condensed water. Likewise, water may be brought into the passage under pressure, so as to provide sufficient water for condensation. Finally, the above-mentioned advantages of the saturated vapor treatment chamber renders the chamber suitable for heating the yarn in a normal texturing or sequential or simultaneous draw texturing process, or for post-treating a yarn textured in a false twist or air jet treatment process.

Some of the objects and advantages of the present invention having been stated, others will appear as the description proceeds when taken in conjunction with the accompanying drawings, in which FIG. 1 is a fragmentary sectional view of one end portion of a yarn heating chamber embodying the features of the present invention;

Figure 15A:
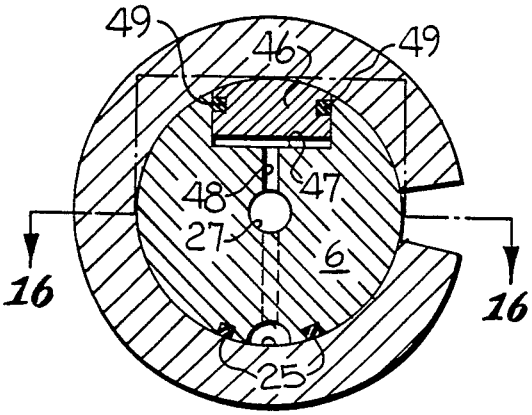
Figure 15B:
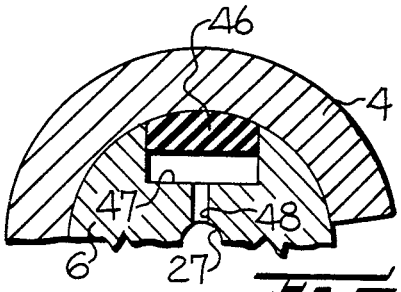
Figure 15C:
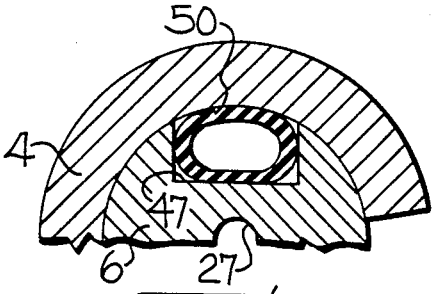
Figure 16:
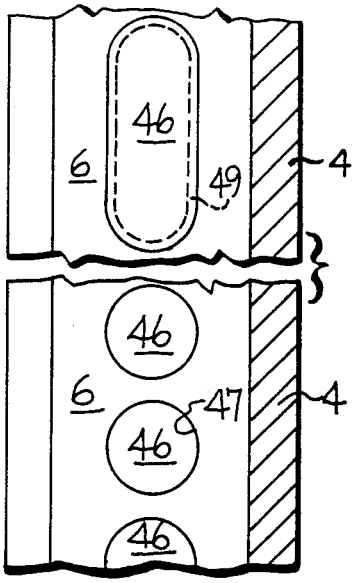
Figure 17:
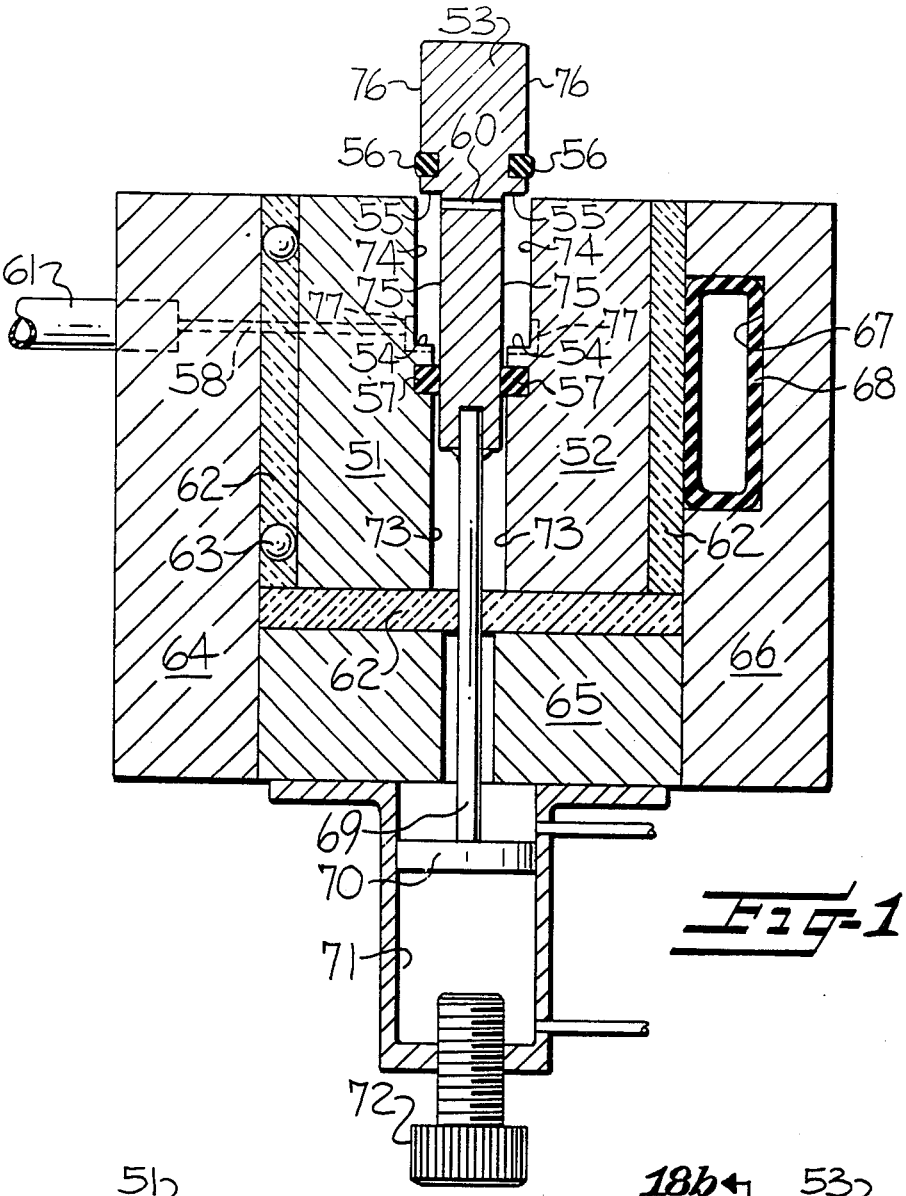
Figure 18B:
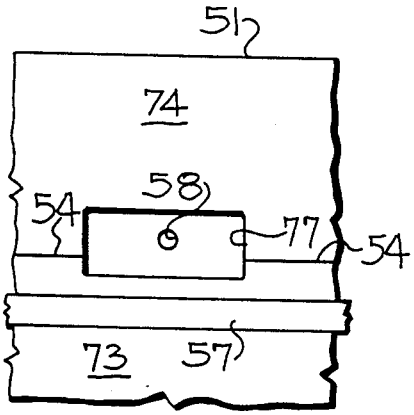
Figure 18A:
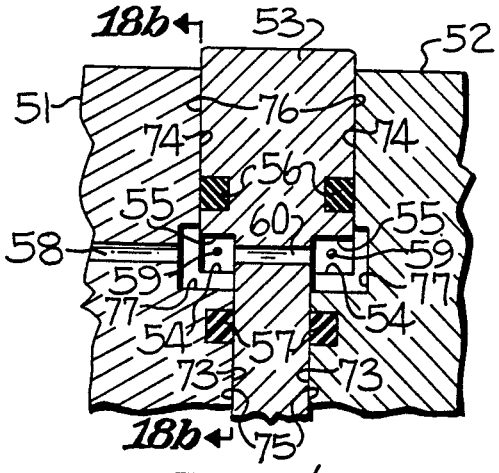
Figure 19:
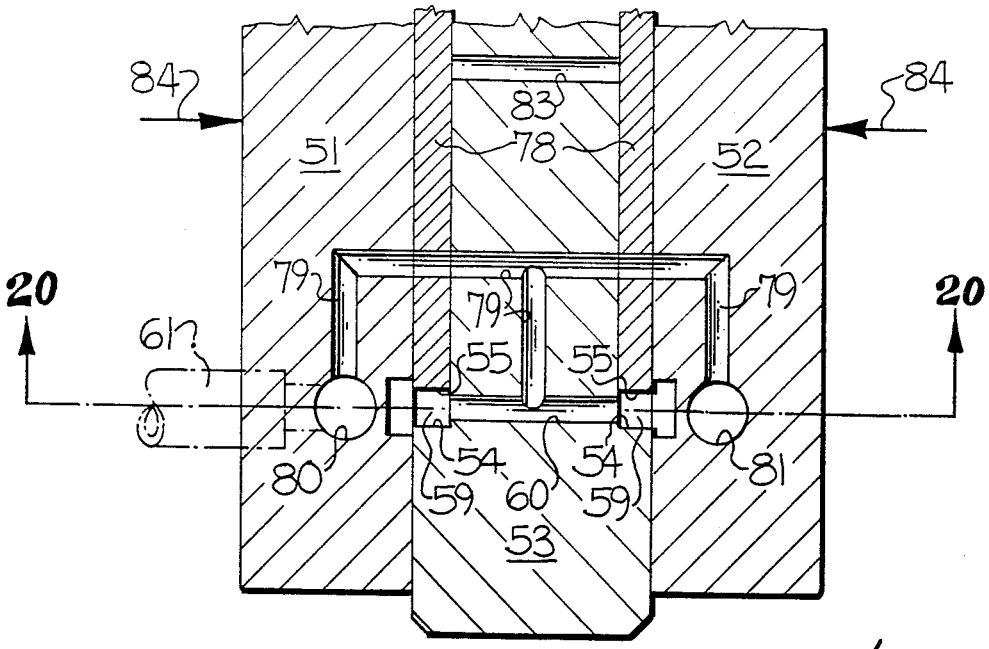
Figure 20:
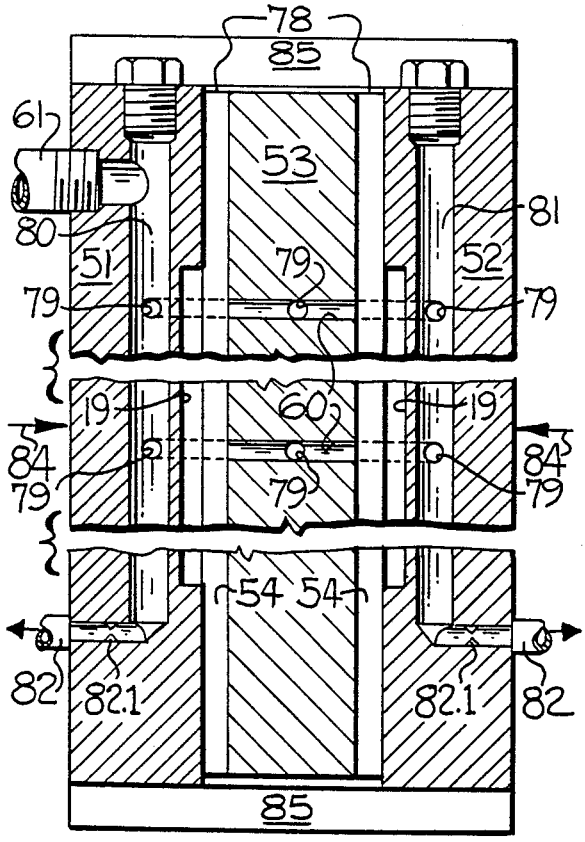
Figure 20A:
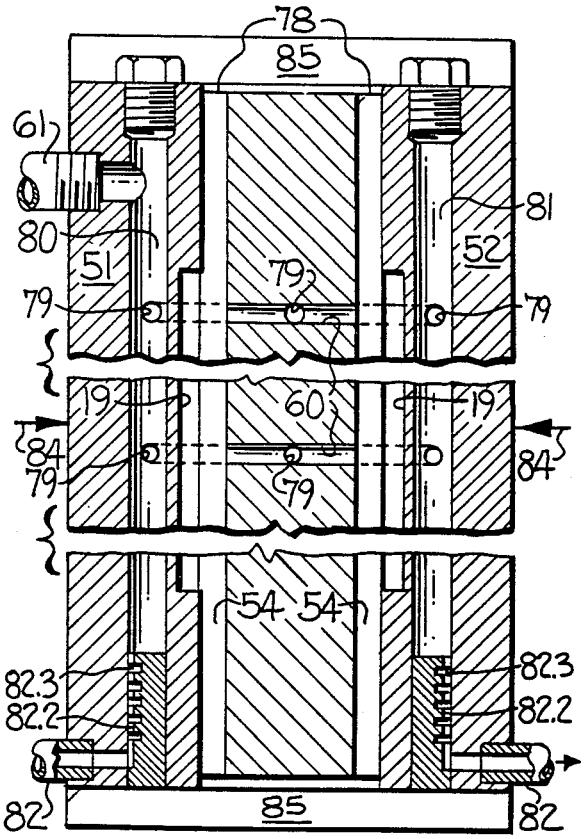
Figure 21:
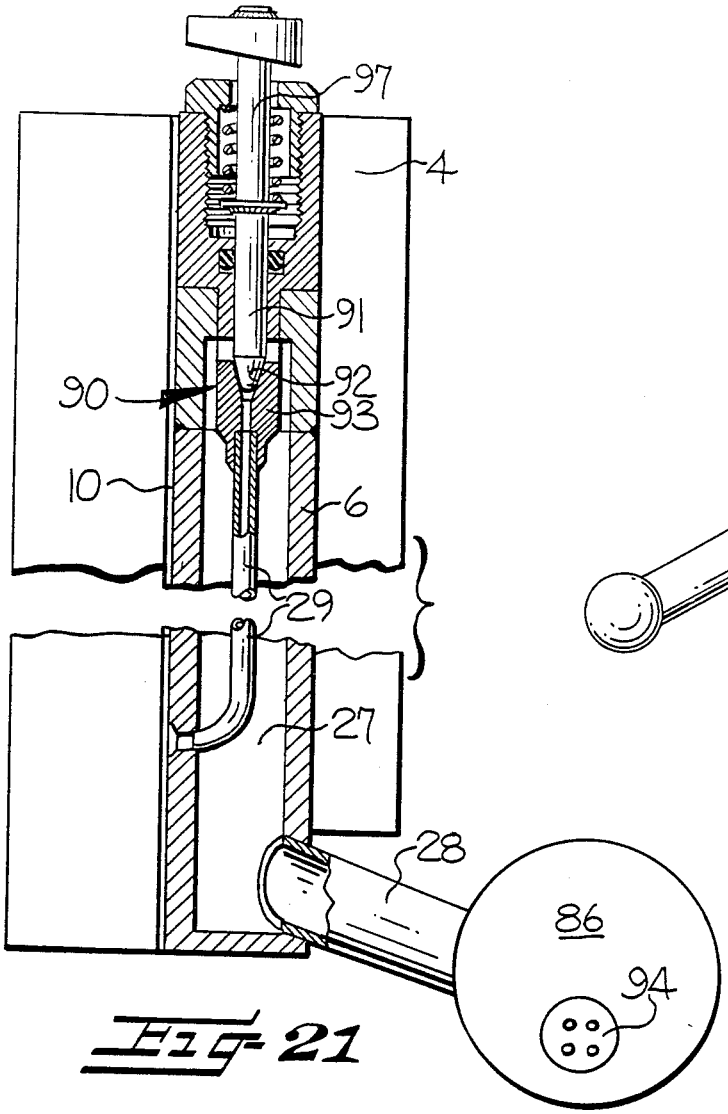
Figure 21A:
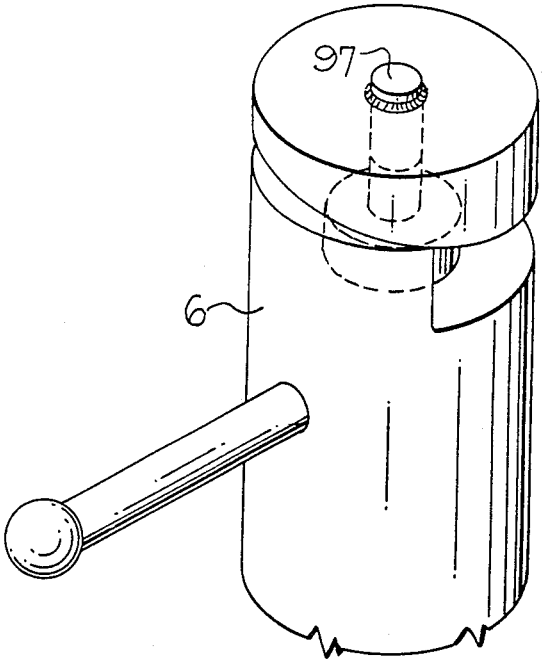
Figure 21B:
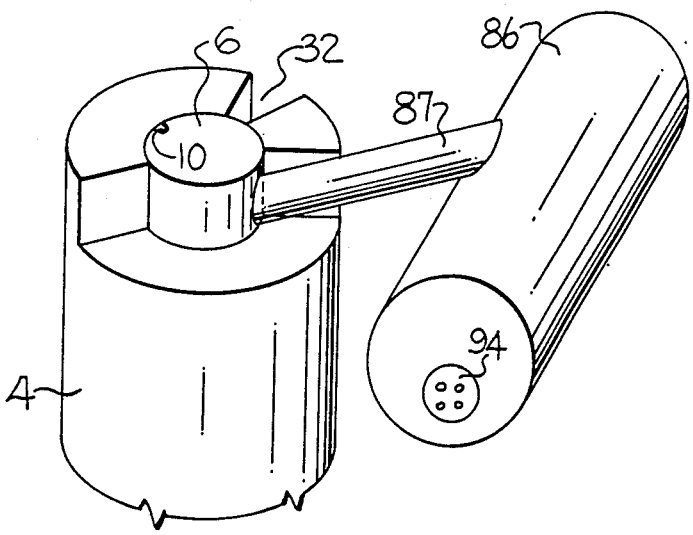
Figure 22A:
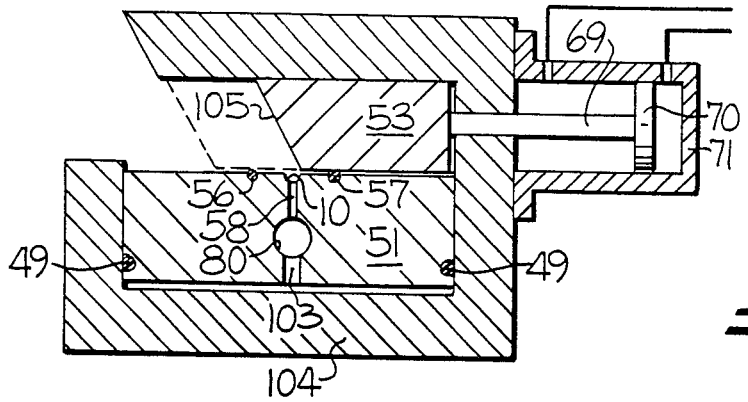
Figure 22B:
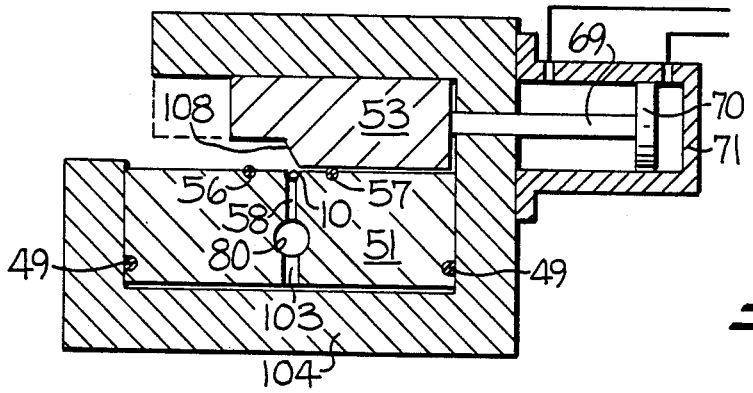
Figure 22C:
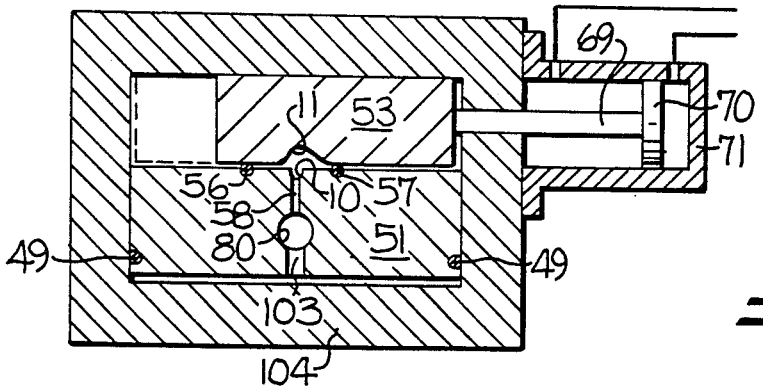
Figure 23:
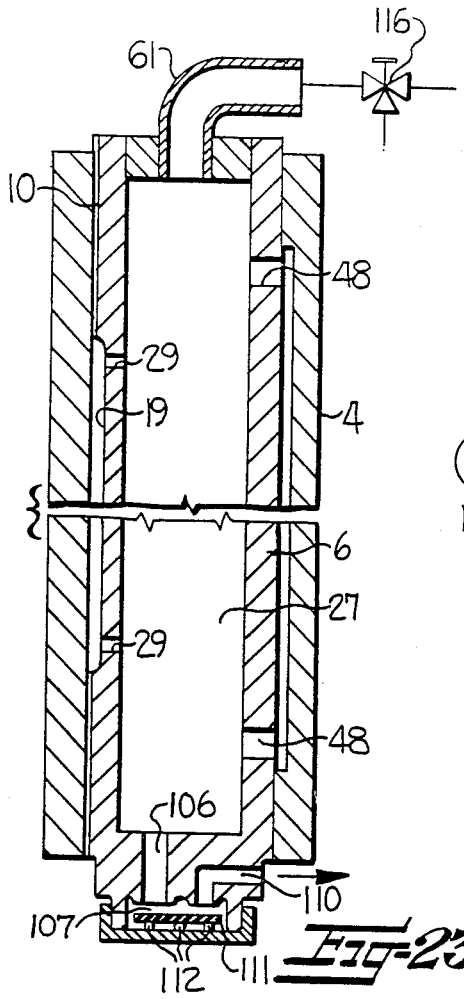
Figure 24:
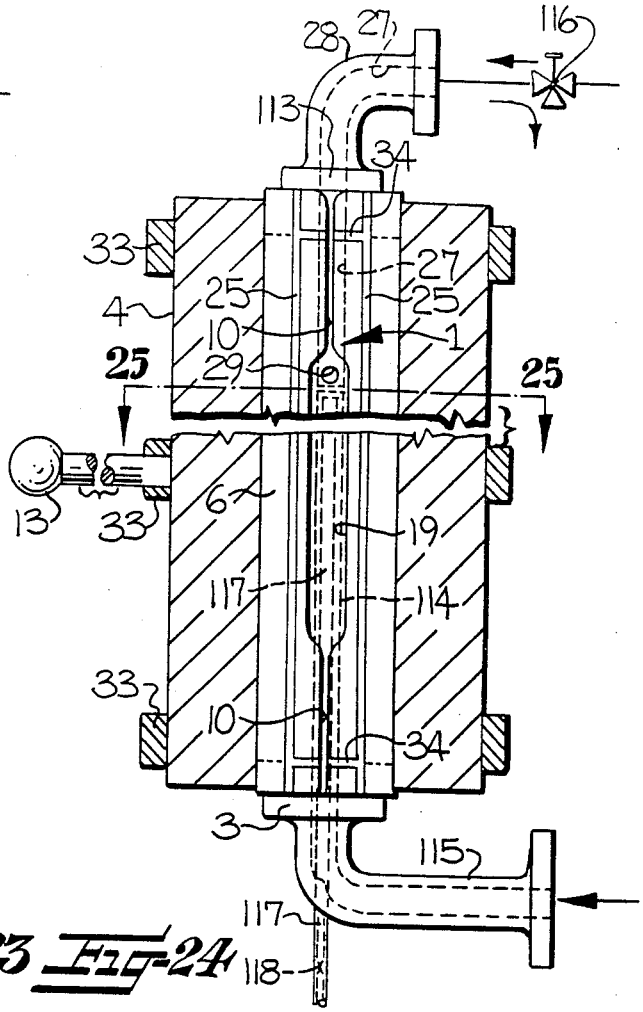
Figure 25A:
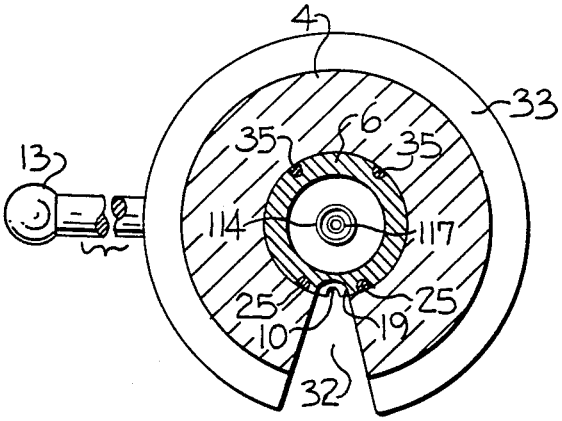
Figure 25B:
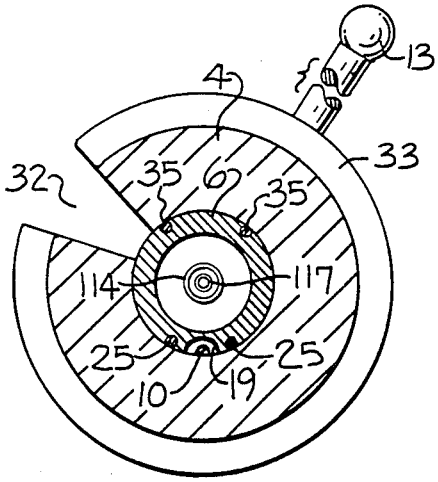

FIGS. 15*a*, 15*b*, and 15*c* are fragmentary sectional views of further embodiments of the present invention;

FIG. 16 is a fragmentary sectional view illustrating the embodiments of FIGS. 15*a*, and 15*b*;

FIG. 17 is a sectional end elevation view of a further embodiment of the present invention;

FIG. 18*a* is a fragmentary sectional end elevation view illustrating the heating chamber of FIG. 17 in its operative position;

FIG. 18*b* is a fragmentary sectional view taken at right angles to FIG. 18*a*;

FIG. 19 is a fragmentary sectional view of an embodiment similar to FIG. 17, but which includes preheating ducts positioned in the side members of the chamber;

FIG. 20 is a sectional view taken substantially along the line 20—20 of FIG. 19;

FIG. 20*a* is a view similar to FIG. 20, but illustrating a further embodiment of the invention;

FIG. 21 is a sectional view of an embodiment of the present invention which incorporates a valve system in the heating duct;

FIG. 21*a* is a fragmentary perspective view of a modified form of the embodiment shown in FIG. 21;

FIG. 21*b* is a fragmentary perspective view of still another modified form of the embodiment of FIG. 21;

FIGS. 22*a*, 22*b*, and 22*c* each illustrate an additional embodiment of the present invention;

FIG. 23 is a sectional view of an embodiment of the present invention and which illustrates the vapor supply system;

FIG. 24 is a sectional side elevation view of a further embodiment of the present invention; and FIGS. 25*a* and 25*b* are sectional views taken substantially along the line 25—25 of FIG. 24, and illustrating the chamber in the threading position in FIG. 25*a* and in the operative position in FIG. 25*b*.

Figure 1:
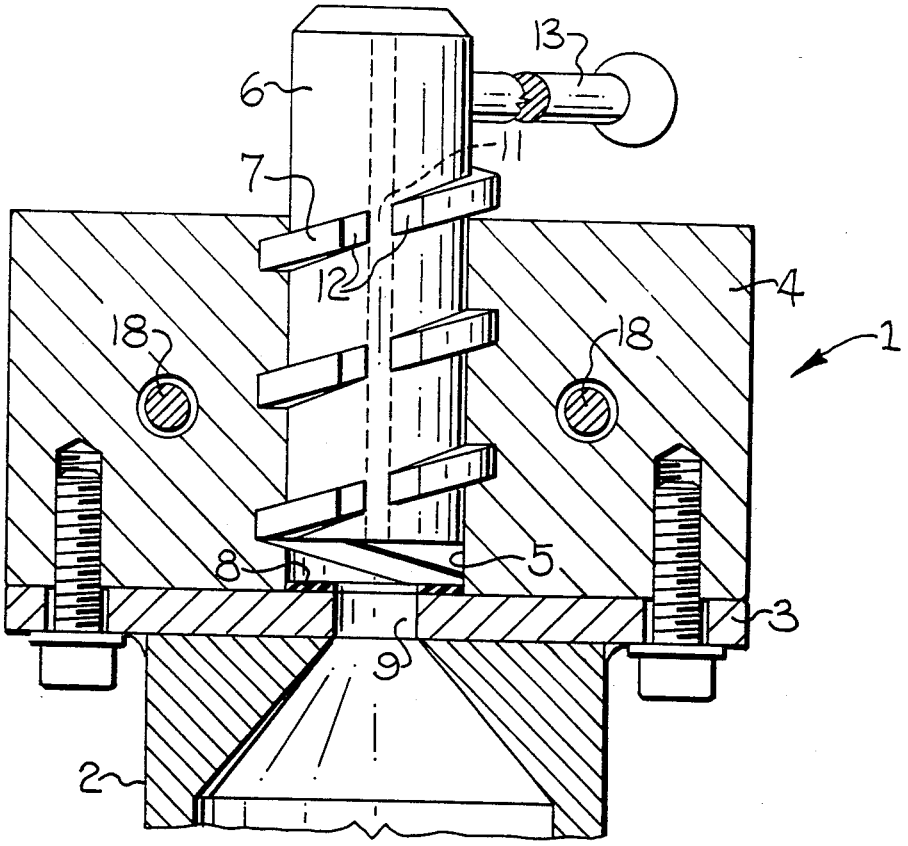

Referring more particularly to the drawings, FIG. 1 illustrates a heating chamber embodying the present invention, and which comprises an elongate tubular member 2, with a yarn inlet 1 mounted at one end thereof. In this regard, it will be understood that the chamber also includes a yarn outlet at the opposite end which is designed to correspond with the inlet 1. The heating chamber further includes a vapor supply duct (not shown) communicating with the interior of the tubular member, by which a hot or heated vapor, and preferably saturated water vapor, may be supplied under a pressure, for example, 20 bar, and with the temperature of the vapor being about 210° C.

An end flange 3 is fixedly mounted at the end of the tubular member 2, and includes an opening 9 which is coaxial with the bore of the tubular member. A first or outer member 4 is mounted on the end flange 3, by an arrangement which provides for a degree of relative movement therebetween, and as further described below. A seal (not shown) may if desired be placed between the end flange 3 and the outer member 4.

The outer member 4 includes a bore 5 which defines an axis 15 (FIG. 2) which is parallel to but laterally spaced from the axis of the opening 9 and tubular member 2. A second or inner member 6, which is in the form of a solid cylinder, is disposed in the bore 5 of the member 4. The inner member 6 includes an external buttress thread 7 which is threadedly received in a corresponding female thread in the bore 5, and such that the members 4 and 6 may be rotated relative to each other with the member 6 moving axially toward and away from the flange 3. The thread of the inner member 6 is adapted as closely as possible to the thread of the inner bore 5 to provide a seal therebetween, and there is further provided a flat sealing ring 8 positioned at the bottom of the bore 5 on the end flange 3. As will be apparent, the sealing ring 8 may consist of a part of a sealing member disposed between the flange 3 and outer member 4.

Figure 2:
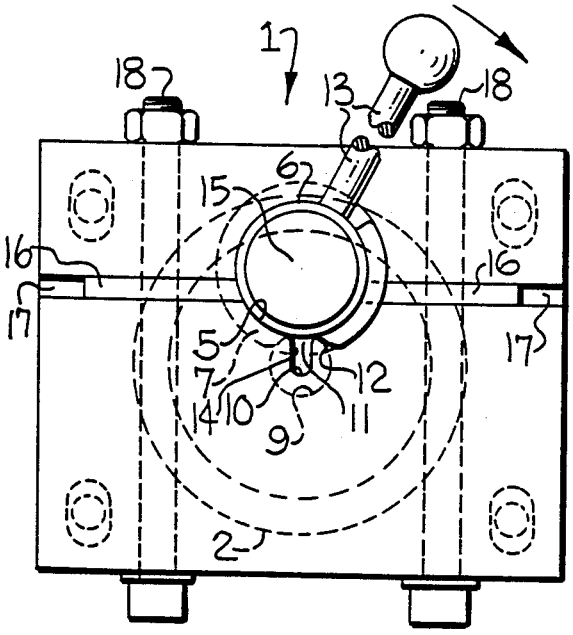
FIGS. 2 and 3 are top plan views of the heating chamber shown in FIG. 1, and with the chamber being illustrated in the threading position in FIG. 2 and in the operative position in FIG. 3.
Figure 3:
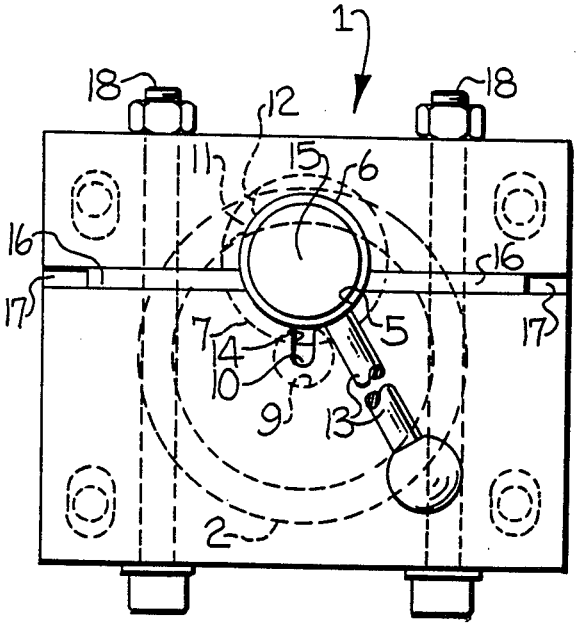

As best seen in FIGS. 2 and 3, the hole 9 in the end flange 3 permits the yarn to pass from the tubular member to the bore 5. A corresponding opening is provided in the sealing ring 8. The periphery of the bore 5, when projected in the planes shown in FIGS. 2 and 3, intersects the hole 9. In addition, the periphery of the bore includes an elongate groove 10, which extends in a radial direction through the thread of the bore and which is axially aligned with the hole 9 of the end flange. This groove 10 serves as the yarn guide passage in the operative position. As best seen in FIG. 1, the inner member 6 possesses a corresponding groove 11 which extends only through the thread 7, but which may also extend radially into the body of the cylinder. The flanks 12 of the groove 11 are inclined in the manner of a funnel. The inner member 6 also includes a handle 13, which permits the inner cylinder to be rotated relative to the outer member 4.

In the relative position shown in FIG. 2, which corresponds to the threading position, the yarn groove 10 in the wall of the bore of the outer member 4. and the groove 11 in the thread of the inner member 6, collectively provide a wide threading opening, through which the yarn may be inserted. For the purpose of pneumatic threading, the ends of the tubular member 2 are shaped in the form of a funnel leading toward the hole 9 in the end flange 3.

By rotating the inner member 6 in the direction of the arrow (FIG. 2), the threading groove 11 in the inner member 6 may be brought to the position shown in FIG. 3, which is the operating position. In doing so, the yarn groove 10, which then serves as the yarn passage, is reduced to a narrow slot, the width of which is so small that the losses of saturated vapor, and the pressure losses, are low. The fact that the flanks 14 of the groove 10, which are cut into the thread of the outer member, extend essentially radially, and the fact that the flanks 12 of the threading groove 11 in the inner member widen in the shape of a funnel, facilitate the movement of the yarn along the flanks 14 into the yarn groove 10 upon rotation of the inner member 6.

Also as seen in FIGS. 2 and 3, the outer member 4 is divided along a plane which extends between the center 15 of the bore 5 and the yarn groove 10 in the outer member. The outer member 4 is thereby divided into two components, and a seal 16 in the form of a flat gasket is placed in the plane between the components, as are a plurality of rigid spacers 17. The seal 16 is elastic and more thick in its relaxed state than the spacers 17, and screws 18 are provided for clamping the two components together after the seal 16 and spacers have been positioned therebetween. Preferably, the thread is cut into the bore 5 of the outer member 4 after having been assembled in the above manner, and in doing so, the seal 16 is also provided with a thread. As a result, the seal 16 seals the thread along both the core and the flanks on both sides of the groove 10. To permit relative movement of the two components of the outer member 4 on the end flange 3, which is necessary upon retightening, the flange screws in the longitudinal holes of the end flange 3 are slightly adjustable. Spacers 17 may be made of relatively soft metal, so that a readjustment of the seal is also made possible by pressing the spacers together. As will be apparent, the spacers may also be omitted, but their use provides the advantage that during assembly the seal may be adJusted without the aid of a technician. The presence of the sealing strips also provides that the separation space between the inner and outer members and bounded by the sealing strips is heated by direct contact with the saturated vapor which penetrates into such area, and so that there is no temperature drop in the area of the yarn groove 10. More particularly, in the operating position illustrated in FIG. 3, it will be seen that the two mating surfaces of the members 4 and 6 overlie each other, with the sealing strips 16 being sealably disposed between the surfaces, and the mating surfaces and strips 16 define a heating enclosure which includes the yarn passage 10. As will be understood, it is not possible as a practical matter to manufacture the mating surfaces with tolerances so precise that there is contact between all areas of these surfaces. Thus, where there is no contact, there is a gap between the surfaces into which the hot vapor may enter and condense, to thereby heat the members to an equal temperature. Where the surfaces are in contact, there is good heat transfer and thus an equal temperature in both members. This advantage of the present invention also applies to the further embodiments described below.

Upon rotating the inner cylinder 6 to the position of FIG. 3, the grooves 10 and 11 no longer overlie each other, and the groove 11 is rotated so that it comes to lie on the other side of the seal 16. In addition, this rotation of the inner member 6 moves the inner member axially into the bore in such a manner that it sealingly engages the sealing ring 8.

Figure 4:
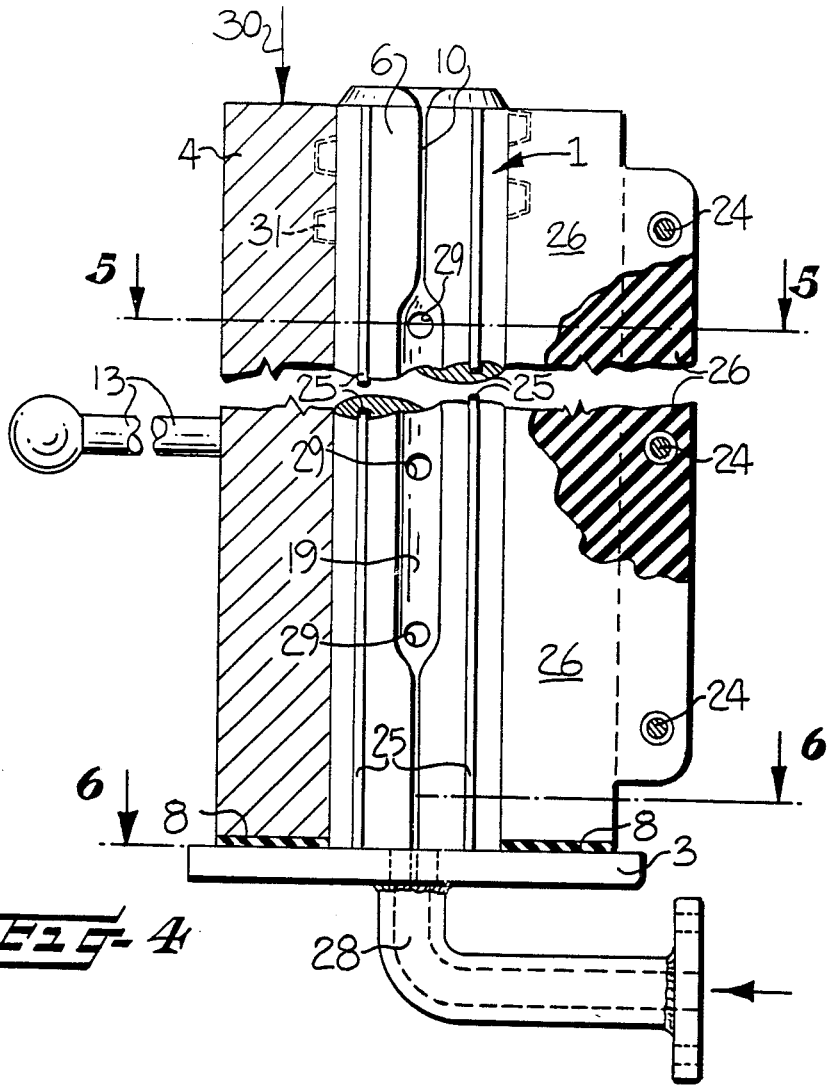
FIG. 4 is a sectional side elevation view of a second embodiment of a yarn heating chamber in accordance with the present invention.
Figure 5:
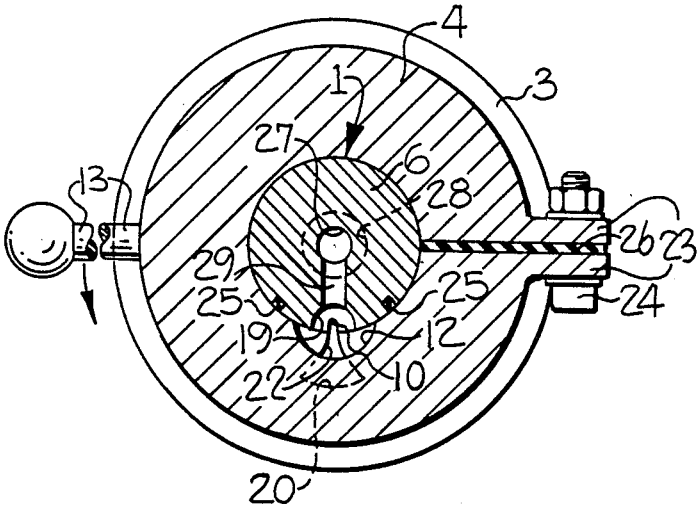
FIG. 5 is a sectional view of the chamber taken substantially along the line 5—5 of FIG. 4.
Figure 6:
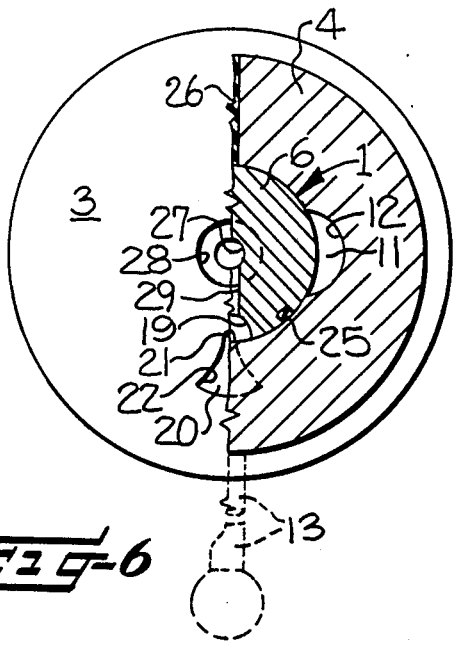
FIG. 6 is a sectional view of the chamber taken substantially along the line 6—6 of FIG. 4.

Referring now to the embodiment of FIGS. 4–6, there is shown a heating chamber which comprises an outer tubular member or sleeve 4 having a generally cylindrical internal bore, and an axially extending groove 11 formed in the inner surface of the bore along at least each end portion thereof. A cylindrical inner member 6, which is fixedly attached to the flange 3, is disposed coaxially in a close fitting relation in the bore of the outer member. The outer member 4 is thus rotatable with respect to the cylinder 6 by means of the handle 13.

The inner member 6 includes a groove 10 in its outer surface which extends along its entire axial length. In the medial portion 19, this yarn groove 10 is widened in a circumferential direction, so that it there creates a heating chamber in which the yarn can move, oscillate, and balloon without contacting the walls. Also, the saturated vapor is introduced into this area under a uniform pressure and, therefore, also has a uniform temperature.

The groove 11 of the outer member 4 includes flanks 12 which gently curve from the bottom of the groove to the wall of the bore. In addition, the flange 3 includes a hole 20, the forward portions 21 of which are aligned with the yarn guide groove 10, note FIG. 5. The flanks 22 of the hole 20 are accordingly aligned with the flanks of the groove 10. Further, the outer member 4 is radially divided and secured by means of flanges 23 and screws 24, so that the member 4 firmly surrounds the outer surface of the inner member 6. An elastic spacer plate 26, for example a sealing plate, may be inserted in the separating plane of the divided outer member 4.

Longitudinal seals 25 in the form of sealing strips are provided on the inner member 6 on respective opposite sides of the yarn groove 10. These seals act to seal the yarn groove 10, including its medial area 19, in the circumferential direction.

The inner member 6 also includes a central bore 27, which serves as a preheating duct, and which communicates with the connecting tube 28 at the bottom of the chamber, and which is closed at the top of the chamber. The bore 27 is supplied through connecting tube 28 with a heated vapor under pressure, such as saturated water vapor. The preheating duct 27 is connected to the yarn groove 10, and in particular to the medial area 19 of the groove 10, by means of the radial passages 29.

The outer member 4 and inner member 6 include coooperating buttress threads 31 (FIG. 4) and thus an axial force may be applied to the outer cylinder 4 in the direction of arrow 30. Thus by rotating the outer member 4 relative to the inner member 6 with the handle 13, the outer member 4 may be sealingly pressed against sealing plate 8 on the end flange 3. In its operating position (FIG. 6), the groove 11 comes to lie behind the sealing strips 25, so that the saturated vapor from the yarn groove is unable to reach the groove 11. Further, the cross section of the groove 10 is reduced by the wall of the outer member 4 to a very narrow passage, which prevents uneconomically large quantities of the heating vapor from escaping. The width of such passage may for example be on the order of less than 0.5 mm.

Upon rotating the outer member to the position shown in FIG. 5, which represents the threading position, the groove 11 of the outer member is brought to a position in which it overlies (viewed vertically), the hole 20 in the flange 3. In addition, the groove 11 overlies in a radially direction the yarn groove 10. Thus a wide threading opening is created, through which the yarn may be inserted pneumatically or by means of a wire or similar means.

Figure 7:
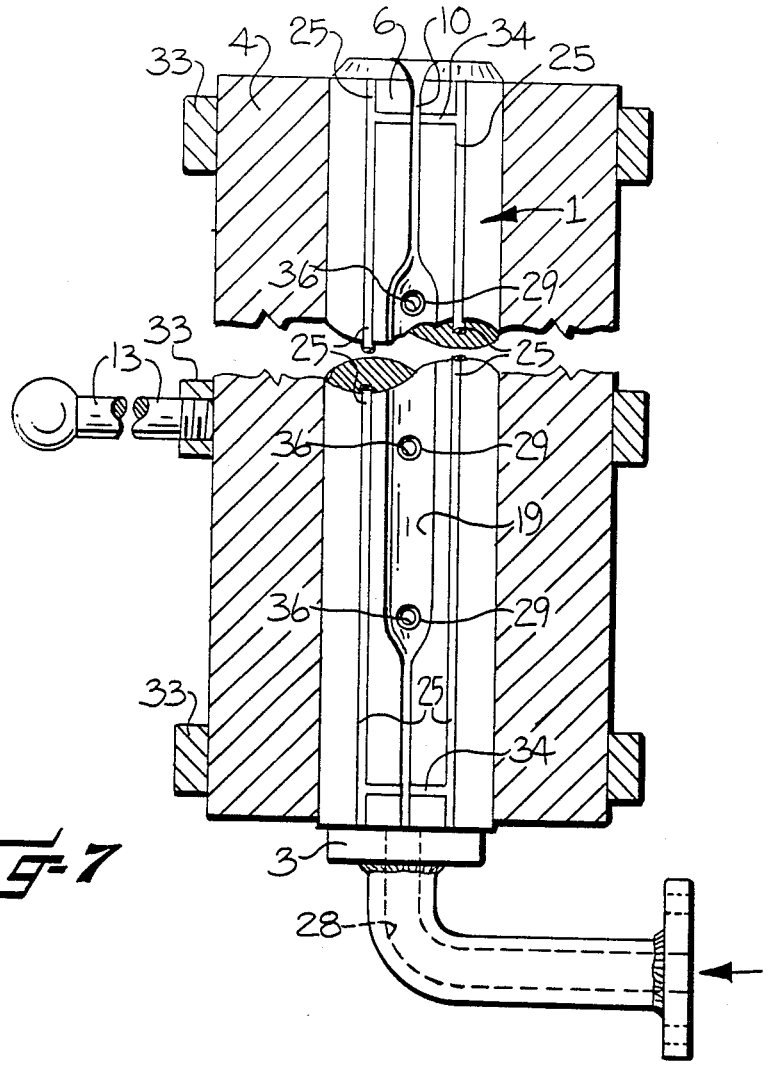
FIG. 7 is a sectional side elevation view of still another embodiment of the present invention.
Figure 8:
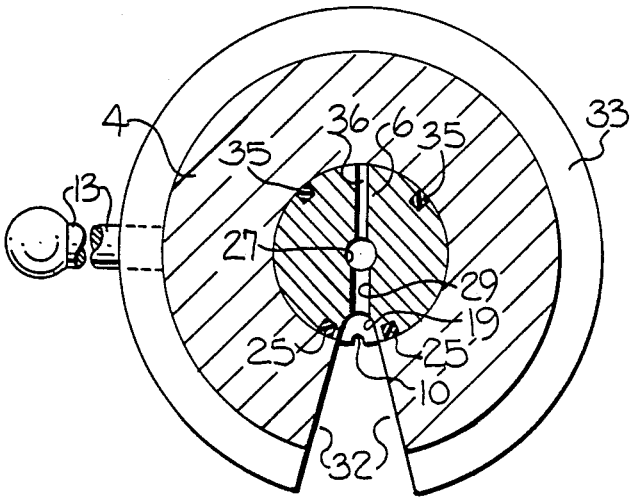
FIG. 8 is a sectional view of the chamber shown in FIG. 7, and illustrated in the threading position.
Figure 9:
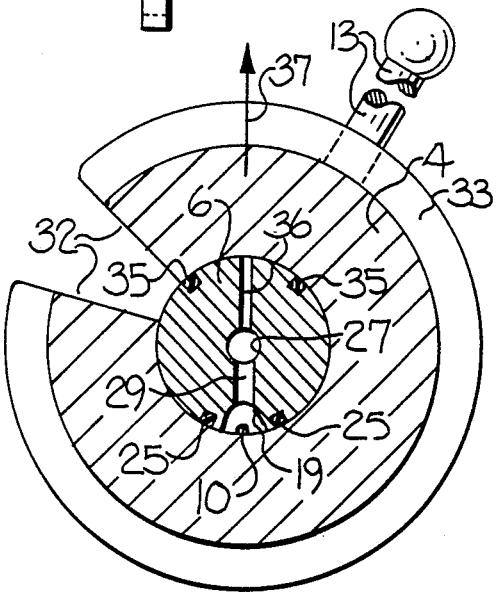
FIG. 9 is a view similar to FIG. 8 but illustrating the chamber in the operative position.

The embodiment illustrated in FIGS. 7–9 largely corresponds to that of FIGS. 4–6. The heating chamber comprises an outer tubular member or sleeve 4, and an inner member 6 having a yarn groove 10. The yarn groove 10 is narrow in the yarn inlet portion 1 and yarn outlet portion, and is widened in the medial area 19. The inner cylinder 6 is fixedly mounted on the flange 3, and its central bore, which serves as a preheating duct 27, is connected to the saturated vapor line 28. The water vapor can exit through the holes 29 into the widened medial area 19 of the yarn groove 10. The outer member 4 includes a slot 32 extending radially completely through the wall thereof along its entire axial length, and the outer member 4 is surrounded by bands 33 for increased strength and is adapted to be rotated by the handle 13.

In the threading position shown in FIG. 8, the yarn inserting slot 32 is aligned radially with the groove 10. It should be noted that the slot 32 can also extend in a manner ranging from a secant to a tangent. In the second rotated or operating position as shown in FIG. 9, the outer member is so rotated that the yarn groove 10 is covered by the surface of the bore of the outer member 4.

Another distinct feature as compared to the embodiment of FIGS. 4–6, resides in the fact that the inner member 6 possesses transverse seals 34 on the yarn inlet and yarn outlet portions, in addition to the longitudinal seals 25. These transverse seals may be O-shaped sealing strips which extend from one longitudinal seal to the other. However, they may also take the form of an O-ring which surrounds the entire member 6. Similarly, the sealing strips 25 and transverse seals 34 can be formed of one piece in the manner of a rectangular window. The sealing strips and transverse seals are mounted in grooves formed in the surface of the inner member, or also on the outer member, so that the seals do not slip by reason of the relative movement of the members. Such grooves are only sufficiently deep that the sealing strips project from the surface of the member, and sealingly contact the surface of the other member in the operating position. This construction applies to all embodiments of the invention.

Figure 10:
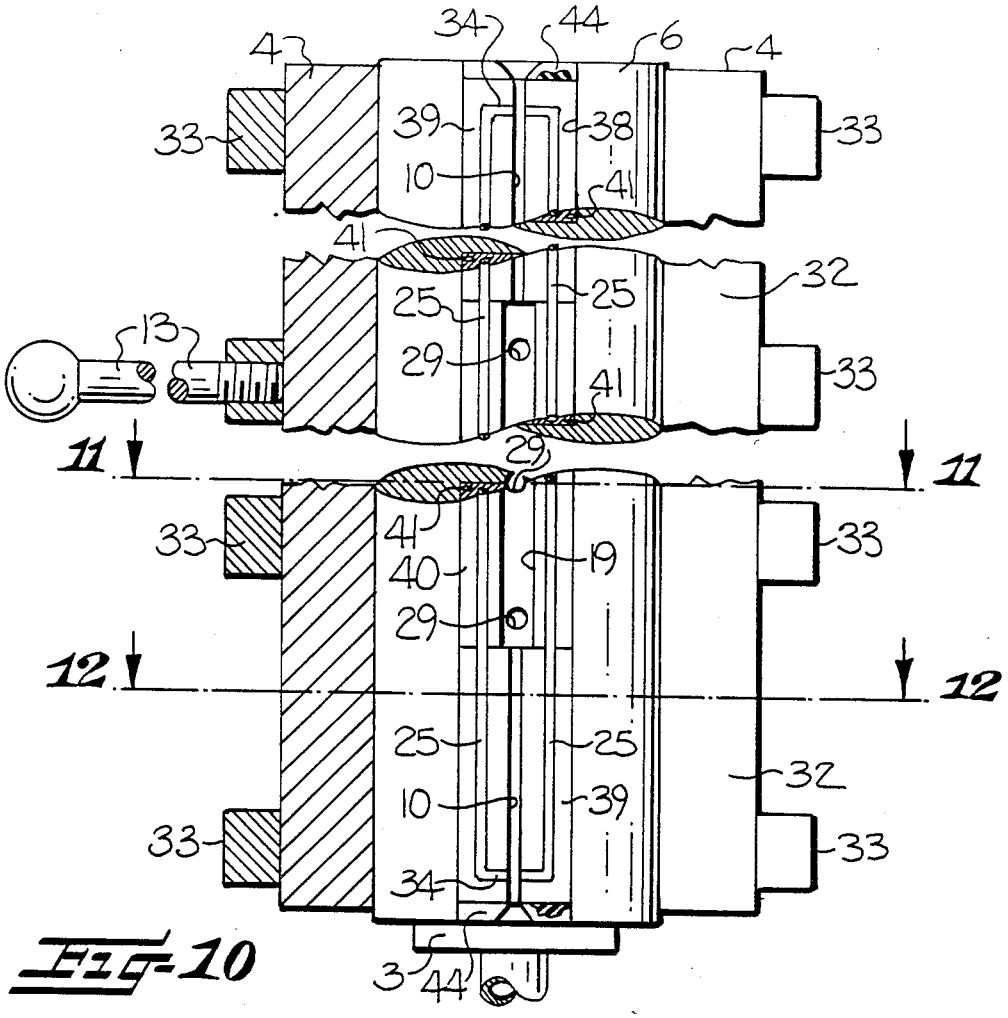
FIG. 10 is a sectional side elevation view of a further embodiment of the present invention.

The use of the transverse seals 34 as shown in the embodiment of FIG. 7 or 10 renders it unnecessary to press the outer member 4 against the sealing plate 8 by an axial force, as is the case in FIG. 4. Furthermore, as shown in FIGS. 8 and 9, additional longitudinal sealing strips 35 are provided on the back side of the inner member 6. Also, a transverse seal (not shown here) corresponding to the transverse seals 34 on the front side may be mounted respectively at the yarn inlet and yarn outlet ends on the back side. The surface defined by these longitudinal sealing strips 35 and their transverse seals receives via line 36 the heating vapor, i.e. the saturated water vapor, from the passage 27. Since the secantial distance between the longitudinal strips 35 on the back side of the member 6 is greater than the secantial distance between the sealing strips 25 on the front side of the member 6, the vapor pressure acts to push the outer member 4 in the direction of arrow 37 against the longitudinal sealing strips 25 on the front side when in the operating position as shown in FIG. 9. This provides a reliable seal of the yarn groove 10 and of the surface area defined by the sealing strips 25 and transverse seals 34. In addition, the heated saturated vapor on the back side serves as an additional heating of both the inner member and the outer member.

Figure 11:
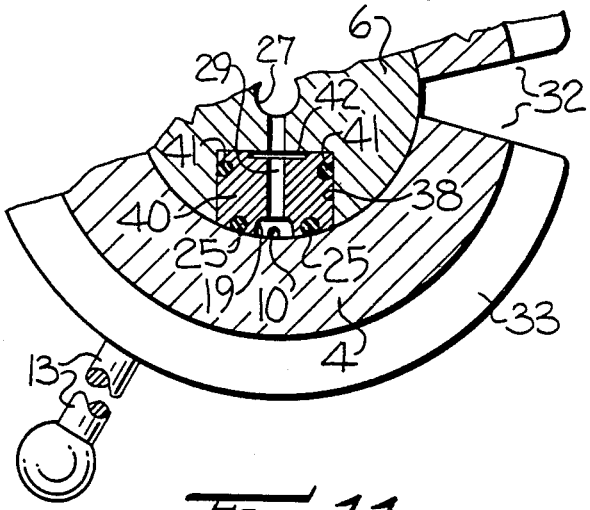
FIG. 11 is a fragmentary sectional view taken substantially along the line 11—11 of FIG. 10.
Figure 12:
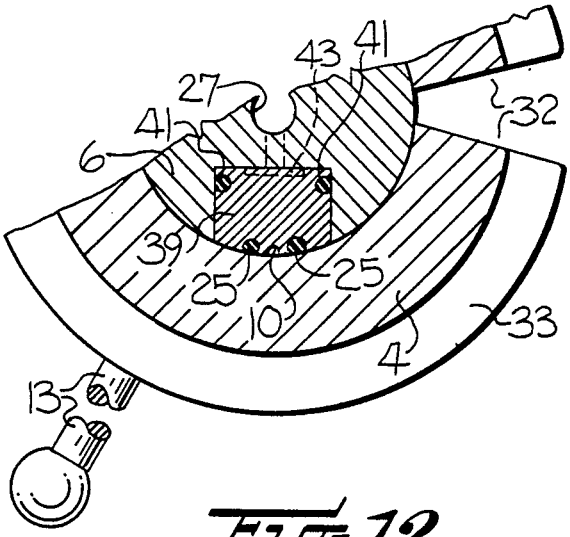
FIG. 12 is a view similar to FIG. 11 and taken substantially along the line 12—12 of FIG. 10.

In the embodiments of FIGS. 10–12, the inner member 6 is again fixedly mounted on the flange 3. The outer member 4 is also designed as a rotatable member provided with a bore having a yarn inserting slot 32. In the threading position (not shown), the yarn inserting slot 32 is aligned with the yarn groove 10, and in the operating position as shown in FIGS. 11 and 12, the outer member 4 covers the yarn groove 10.

A channel 38 extends axially along the outer surface of the inner member 6, and the channel preferably is of uniform width and depth over its entire length. The channel 38 accommodates inserts 39 and 40. The inserts 39 form the yarn inlet portion and the yarn outlet portion, and include a narrow yarn groove 10, as best seen in FIG. 12. The insert 40 forms the medial portion 19 of the yarn guide passage and can accordingly possess a yarn guide passage of widened cross section, note FIG. 11. Inserts 39 and 40 are sealed over their entire length with longitudinal sealing strips 25 on both sides of the yarn passage. Sealing strips 41 seal the sides of the inserts with respect to each side of the channel 38. In order to provide a certain mobility for the inserts, the sides of the insert channel and the sides of the inserts are aligned parallel to each other.

The insert 40 possesses on its back side a longitudinal groove 42, which is penetrated by holes 29 extending from the yarn groove 10 to the central preheating passage 27. Since the secantial distance between the sealing strips 25 on the front side of the inserts 40 is smaller than the secantial distance between the sealing strips 41, the insert is biased by the vapor pressure toward the inner surface of the member 4.

As noted above with respect to the embodiment of FIG. 7, the inserts 39 are provided with transverse seals 34. If desired, the inserts 39 may also be provided with a longitudinal groove 43 along their back side for receiving the pressurized vapor. Similarly, it is not absolutely necessary that a separate vapor duct be provided to supply the longitudinal groove 43 with vapor, since the vapor pressure from the groove 42 of insert 40 will provide an adequate pressure also on the back side of the inserts 39. Even in the absence of a longitudinal groove 43, or where it extends only a short distance from insert 40 toward the yarn inlet or yarn outet, the vapor pressure formed behind the inserts 39 is sufficient to provide an adequate contact pressure of the sealing strip 25 on the inner surface of the member 4. It should also be noted that a current develops in accordance with the pressure drop in the yarn inlet and yarn outlet, so that the static pressure on the back side of the insert 39 is greater than the static pressure on the front side of the insert. Also, in the case of inserts 39, the sealing strips 41 provide that the back side is sealed with respect to the vapor.

As best seen in FIG. 10, the ends of the insert channel 38 are sealed by a sealing plate 44, which is firmly fitted in the ends of the channel 38 and sealed. Also, sealing plates may be used, which are mounted at the ends of the inner member 6.

Figure 13:
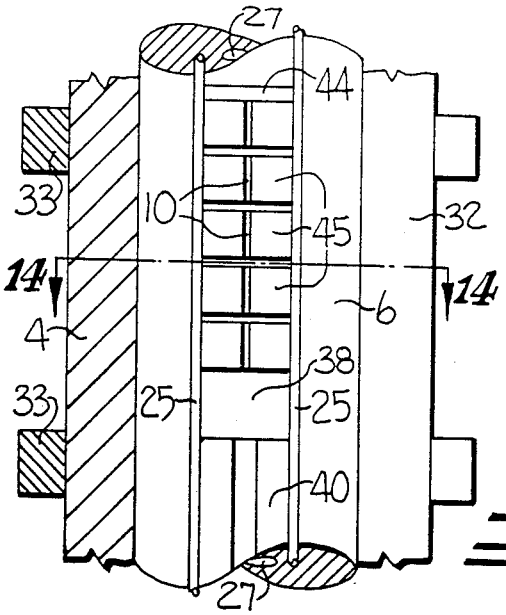
FIG. 13 is a fragmentary sectional side elevation view of still another embodiment of the present invention.
Figure 14:
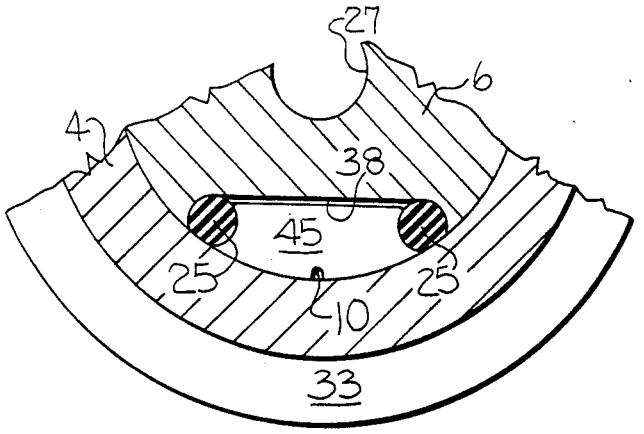
FIG. 14 is a fragmentary sectional view of the embodiment shown in FIG. 13.

In the embodiment of FIGS. 13 and 14, the yarn inlet portion and the yarn outlet portion of the heating chamber is formed in particular by a plurality of relatively thin inserts 45. For this purpose, the inner member 6 includes an insert groove 38 of the type also shown in FIGS. 7 and 10. The sides of the insert groove 38 are however convergingly shaped so that they provide a support on each side for a sealing strip 25, note FIG. 14. In its medial area, the heating chamber consists of an insert 40, and as will be apparent, this insert 40 may if desired be omitted or replaced with individual, shorter inserts. The inserts 40 and 45 have sides which are also adapted to the sealing strips 25, and which permits the inserts to be clamped between the strips 25. Since there is an open space between the sealing strips, a static pressure will develop behind the strips, whereas a current with a corresponding reduction of the static pressure develops in front of the strips. Thus, in this embodiment the sealing strips are also pressed forwardly against the inner surface of the member 4.

In the embodiments of FIGS. 10–14, the inserts may consist of a particularly wear resistant material, such as for example ceramic, and in particular a sintered ceramic or sintered metal. The advantage of this construction is that when worn, or when the denier of the yarn to be processed is changed, the inserts may be readily removed and replaced. Further, the inserts may be easily mass produced, and the wide channel in the surface of the member 6 is easier and less costly to manufacture than a very fine yarn groove.

The embodiments of FIGS. 15*a* and 15*b* are distinguished in that the contact pressure of the inner member 6 against the inner surface of the member 4 does not occur directly as in FIGS. 8 and 9, but is provided by inserts 46 which are mounted in a channel 47 on the back side of the member 6. The insert channel 47 receives vapor pressure via passage 27 and radial bore 48. As shown in FIG. 15*a*, longitudinal sealing strips 49 and transverse seals are provided which seal the insert 46 with respect to the sides of the channel. It should also be noted that corresponding transverse seals are present, which are not shown in the illustrated views. Depending on the surface ratio of the surface which is defined on the front side of the inner member 6 by the sealing strips 25 and the corresponding transverse seals, to the surface which is defined by sealing strips 49 and the corresponding transverse seals, the inserts 46 can extend over a more or less extended length of the inner member 6. As shown in FIG. 16, the insert may extend over a partial length and have a cross section in the shape of an oval. Here, an annular O-ring can function as a longitudinal and a transverse seal. In the remaining portion of FIG. 16, there is illustrated an insert groove 47 with an insert 46 having a cylindrical outline.

The inserts 46 as shown in FIG. 15*b* may consist of rubber stoppers which are sealingly placed into the channel 47. As shown in FIG. 15*c* the insert 50 may consist of a hose or an elastic member, which is disposed in the insert channel 47 over a predetermined length, and which is supplied with a pressure fluid, preferably saturated vapor, via a suitable connection line (not shown).

FIG. 17 illustrates a double yarn heating chamber which embodies the features of the present invention. The chamber of this embodiment comprises an elongate first member composed of two longitudinally extending side plates 51 and 52 which are disposed in a parallel, laterally spaced apart relationship. The plates 51 and 52 have opposing faces defined by the planar surfaces 73, 74, and the shoulder 54. The opposing faces are laterally aligned so as to define in cross section between the two plates an outer relatively wide channel positioned above the shoulders 54 as seen in FIG. 17, and an inner relatively narrow channel positioned below the shoulders 54.

An elongate second member 53 is disposed between the opposing faces of the side plates 51 and 52, and extends along the longitudinal length thereof. The second member includes opposite faces defined by the surfaces 75 and 76, and the intermediate shoulder 55. The shoulders 55 of the member 53 oppose respective ones of the shoulders 54 of the first member, and such that the second member 53 comprises in cross section an outer or upper portion as seen in FIG. 17 which is sized to be closely received within the outer channel of the first member, and an inner or lower portion as seen in FIG. 17 which is sized to be closely received within the inner channel of the first member.

In the illustrated embodiment, the shoulders 54 and 55 are of the same size, and are planar. However, the shoulders can be designed differently, for example it is possible to configure the shoulders so as to be concave in cross section, and the shoulders can be slightly curved in the direction of the yarn travel so that the yarn is guided into contact with one of the shoulders. It is also possible to have the side surfaces curved in the direction of yarn travel, instead of planar, and so that the yarn is guided into contact with one of the side surfaces. In each case, a curved yarn passage is thereby provided.

The member 53 with its planar sides 75, 76 is slideably guided between the planar sides 73, 74 of the plates 51 and 52. In the position shown in FIG. 17, which represents the threading position, a longitudinal slot is formed along each side of plate 53, since the shoulders 55 project slightly beyond the front face of the plates 51 and 52. An advancing yarn can thereby be laterally inserted through these longitudinal slots into the passage formed between the plates 51 and 53, and 52 and 53. The plate 53 may then be moved rearwardly to a position as shown in FIG. 18*a*, which represents the operating position. In this position, two narrow, parallel, straight or if desired curved, yarn passages are formed. Each yarn passage is defined by the surface 74 and shoulder 54, and by the surface 75 and shoulder 55. Both yarn passages receive saturated water vapor through vapor connection 61 and duct 58, as well as the intermediate duct 60 which passes through the member 53. For this purpose, and as best seen in FIGS. 18*a* and 18*b*, a recess 77 is formed in the surface 74 and shoulder 54 of the side plates 51 and 52 in the area which communicates with the vapor duct 58 and duct 60. The recess 77 widens the yarn passage, and serves to permit the vapor to be supplied through the duct 58 and flow unrestricted into the duct 60 and so that there are identical pressure and temperature conditions in the two adjacent yarn passages. However, it is also possible to provide the recess over a greater length, so that there remains only a narrow gap in the inlet area and the outlet area for passage of the yarn 59. In these areas, the gap typically measures about 0.2 to 0.3 mm wide and has a length of about 60 mm or more. Thus, a 167 dtex yarn may be treated with saturated water vapor, at temperatures of about 220° C. and a pressure of about 24 bar, without being damaged by wall friction.

The plates 51, 52 and 53 of the heating chamber of FIG. 17 are substantially surrounded by an insulating material 62. The plates are also surrounded by a housing composed of plates 64, 65, and 66, and which is sufficiently strong to absorb the pressures developed in the interior of the yarn passageways, and the forces produced thereby. In order to press the plates 51, 52 and 53 together, there is provided a channel 67 in the outer plate 66 which snugly receives an elastic hose 68. The hose preferably extends substantially along the entire length of the heating chamber, and it has an oblong cross section, so that the width at which the hose rests against the side surface of the plate 52 is greater than the width of the yarn passage in the operating position. Thus the hose 68 may be supplied with a pressure approximately reduced by the surface ratio, so as to sealably press the plates 51, 52 and 53 together.

The hose 68 may be connected to a compressed air supply system, but is preferably connected to the supply system of the heated vapor. For this purpose, the hose 68 can be filled, for example, with a vapor or fluid, which is in turn acted on by the pressure of the heating vapor. To achieve the above mentioned advantages of additional heating of the plates, which have no preheating duct, it is preferred to supply the heated vapor to the hose itself. A plurality of balls 63 are provided for transmitting the forces applied by the hose to the plate 64 and to the grouping of plates 51, 52 and 53.

To seal the yarn heating chamber, at least one sealing strip 56 or 57 is respectively arranged on each side of each yarn passage. These sealing strips are flexible within limits, and they extend along the shoulder and serve to avoid the need to manufacture the surfaces 73, 74 of the plate 51 and the surfaces 75 and 76 of the plate 53 to exacting tolerances. Also, these sealing strips make it possible to create a defined surface area, into which the heated vapor can penetrate for the purpose of additional heating. To seal this surface area in the direction of yarn travel, there are also provided transverse seals at the yarn inlet and yarn outlet, which extend between the longitudinal seals. Such a transverse seal may also be achieved by widening the longitudinal seals at their ends, so that they extend immediately adjacent the yarn passage or the respective shoulder.

The center plate 53 is displaced by a cylinder-piston assembly 70, 71, and which includes the piston rod 69. Numeral 72 refers to a stop screw, by which the gap width in the yarn treatment chamber may be adjusted during operation.

FIGS. 19 and 20 represent longitudinal and cross sectional views of the plates 51, 52, and 53. The disclosed embodiment closely corresponds to that of FIGS. 17 and 18, however, the outer plates 51 and 52 are flat and an intermediate plate 78 is positioned on each of these plates and which has a thickness corresponding to the width of the shoulder of the inner plate 53. This arrangement results in a simplification in manufacture. In addition, the vapor supply duct 60 which extends through the center plate 53 and between the shoulders 54 and 55, is connected to a duct 79 which extends through the surfaces between the plates 51, 52 and 53, as well as the intermediate plate 78. The duct 79 is supplied with the heated vapor from the connection 61 via a bypass duct 80. The bypass duct 80 extends along the shoulder 54, and another bypass duct 81 is provided in the other plate 52, which extends along shoulder 55 and is connected to the duct system 79. These bypass ducts serve as preheating ducts for the plates 51 and 52. As shown in FIG. 20, the bypass duct is connected at its upper end to a vapor supply line 61, and the bypass ducts 80, 81 are connected to a lower condensate drainage line 82. The condensed water which accumulates at the bottom of bypass ducts 80, 81, reaches, via throttles 82.1 (which may be adjustable), a tank, from which it is returned to a vapor generator by a pump. Automatic and preferably thermostatically controlled condensate drainage valves are connected at the bottom of the bypass ducts 80, 81, which provide for a constant drainage of the condensate. The described drainage valves, collection tank and condensate pump are not illustrated in the drawings.

One advantage of the described vapor supply system is that when the center plate 53 is moved from its operating position, the vapor supply is automatically disconnected. Another advantage resides in the fact that at least the bypass duct 80 continues to be supplied with the heating vapor in the threading position of the plate 53, and consequently the side plate 51 does not cool particularly in the area of the shoulder 54. In the threading position of the plate 53, the heating fluid can also be supplied to the bypass duct 81 via an additional duct 83 shown in FIG. 19, and which is aligned in the threading position with the portion of the vapor duct 79 in the plate 52 and which leads to the bypass duct 81. This additional duct 83 also insures the supply of the heating fluid to the bypass duct 81 in the threading position of the plate 53. The supply of the bypass ducts with heating fluid in the threading position offers the advantage that, by reason of the continued surface contact between the plates, all of the plates forming the heating chamber are continued to be heated. This advantage applies to all of the embodiments of the present invention.

Referring again to FIG. 20, it will be noted that the yarn passage formed by the opposing shoulders 54 and 55 is widened in the central area 19 of the heating chamber. Also, as noted above with regard to FIGS. 17 and 18, the three plates are held together by external forces. These external forces are indicated in FIG. 20 by the arrows 84. The forces should be sufficiently strong so that the frictional force between the plates 51, 52 on the one hand, and 53 on the other hand, exceeds the vapor pressure force operative on plate 53. In order to provide a particularly strong construction, the heating chamber may be further provided with braces 85 extending between the plates 51 and 52.

FIG. 21 schematically illustrates the manner in which the preheating ducts 27 in the above-described embodiments may be constructed. As illustrated, the preheating ducts 27 of several identical heating chambers are connected at their lower ends to a connecting tube 28. The tube 28 in turn leads to a common vapor generator 86 having a suitable heating system 94, for example an electric resistance heating tube. The connecting tubes 28 serve both to supply the heated vapor, and as a return path for the condensate. For this latter purpose, the tubes are disposed at an inclination and have a large diameter.

The upper end of the inner member 6 mounts shutoff means in the form of a needle valve 90, which is installed so that the preheating duct 27 is continuously supplied with saturated vapor and heated to the temperature of the saturated vapor, and yet which provides that this vapor can reach the yarn passage only via the needle valve 90. For this purpose, the connecting tube 29 is tightly connected to the valve seat 92 of the housing 93. The connecting tube 29 also corresponds to the duct 79 as seen in FIGS. 19–20. The valve can be actuated from the outside, and the structure is such that the valve seat 92 is only released or opened by the axially movable valve needle 91 when the yarn passage 10 is radially closed by the relative rotation of the two cylinders 4 and 6, i.e. the yarn heating chamber has been brought to its operating position. In the threading position of the yarn passage 10, as shown in FIGS. 2, 4–5, 7–8, and 10, the needle valve 90 is tightly closed, so that the out flow of vapor is precluded. This function is necessary to protect the operating personnel from accidents. To avoid additional operating errors, the valve spindle 97 which forms an extension of the needle 91, extends outwardly from the heating chamber. The spindle 97 is operatively connected to a cam arrangement as shown in FIG. 21*a*, so as to effect movement of the needle 91 upon rotational movement of the outer member 4. Thus, the two movements are coupled or synchronized, taking into account the necessary idle movements resulting, for example, from the spacing of the sealing strips 25 on opposite sides of the yarn passage 10. The advantage of the siphon like, upwardly bent connecting tube 29, which proceeds from the top of the preheating duct, is that inert, i.e. non-condensible gases, which accumulate in the dead spaces, are constantly removed through this connecting tube.

It should also be noted that it is possible to arrange the shutoff means at the bottom of the inner member 6. This however is disadvantageous in that possibly non-condensible, inert portions of the heating fluid, such as air or the like, may accumulate in the upper end of the member 6 and result in time in temperature differences from one member 6 to another, unless a separate drainage duct for inert gases is provided.

The common vapor generator 86 may be connected at the upper end of the member 6 (note FIG. 21*b*), but this construction renders it necessary that a separate condensate return line be arranged at the lower end of the member 6, possibly with a condensate pump leading to the vapor generator.

Finally, with respect to the embodiment of FIG. 21, a certain quantity of water needs to be constantly supplied, aside from the backflowing condensate, to the common vapor generator, so as to replace the heating vapor which is carried away by the treated yarn from the heating chamber. This additional water is preferably provided by a water feed pump which is controlled by a high pressure float or the like.

FIG. 22*a* is a cross sectional view of a heating chamber which embodies the features of the present invention, and which comprises a first member which comprises an elongate plate 51 having a generally flat upper surface, and with a groove 10 formed in the flat surface and extending along the length thereof. A pair of sealing strips 56 and 57 are mounted in grooves in the upper surface of the plate 51 and so as to extend along respective opposite sides of the groove 10. A second member which comprises an elongate plate 53 has a generally flat lower surface overlying the surface of the plate 51. The two plates 51 and 53 are mounted with the respective surfaces thereof in an opposing, contiguous relationship and for movement along a direction which is generally parallel to the surfaces and transverse to the direction of the groove 10. In particular, the plates are movable between an operating position shown in dashed lines, and wherein the surface of the plate 53 overlies the groove 10 to define a relatively narrow yarn passage, and a threading position shown in solid lines wherein the surface of the plate 53 is positioned relative to the surface of the plate 51 to define an enlarged opening to facilitate thread-up of the yarn.

In the operating position, the yarn passage is supplied with saturated vapor via the preheating duct 80 and bore 58. Vapor is also supplied to the back side of the plate 51 through a bore 103. As a result, the plate 51 which is sealed in a housing 104 by continuous seals 49, is pressed against the other plate 53, so that these plates lie against each other so as to be impermeable to vapor by reason of their sealing strips 56, 57. It is noteworthly that the surface area defined by the continuous seals 49 is greater than the surface area defined by the longitudinal sealing strips 56, 57 and their associated transverse seals. With the use of this type of contact pressure, the housing 104 is also heated, which further contributes to a uniform temperature of all portions of the heating chamber.

FIG. 22*b* shows a heating chamber which differs from that shown in FIG. 22*a* only in that the front side of the plate 53 is provided with a step 108. The embodiment of FIG. 22*c* is also similar to FIG. 22*a*, but differs in that in the threading position, the plate 53 does not expose a lateral yarn threading slot above the yarn guide groove. Rather, there is provided an enlarged longitudinal groove 11 in the lower surface of the plate 53 which, in the illustrated threading position, is in alignment with the groove 10 and forms a widened threading opening through which the yarn can easily be threaded pneumatically, or with a wire. Threading groove 11 is provided on one side with an inclined surface, so that the yarn is pushed by this inclined surface into the yarn guide groove 10 when the plate 53 is displaced to its operating position, which is shown in dashed lines.

In all of the embodiments shown in FIGS. 22*a*–22*c*, the housing 104 rigidly encloses the two plates for resisting the separating force exerted by the heated vapor in the groove 10 and to thereby insure that the plates lie tightly against each other and against their longitudinal and transverse seals. In the embodiment of FIG. 22*c*, the housing encloses all sides of the two plates.

As noted above, FIG. 20 shows a vapor connection 61 in the plate on the left side, and which terminates in the upper area of the preheating duct 80. The condensate drainage line is indicated at 82 and proceeds from the lower portion of the duct 80. A throttle 82.1 is provided, through which the condensates and inert gases, which accumulate in the lower portion of the preheating duct 80, can slowly escape. In FIG. 20*a*, the preheating duct 80 extends to the end of the side plates 51, 52, and is closed with a plug, which has over its length a narrow gap-shaped groove 82.2 and blind holes 82.3.

Other condensate separators, in particular temperature actuated condensates separators, are known in the literature (for example Dubbel, "Taschenbuch, Furden, Maschinenbau", 14th Edition, Pages 500–501). A preferred embodiment of a condensate separator is shown in FIG. 23. In this embodiment, the heating chamber corresponds to that shown in FIGS. 4–16, and comprises a stationary tubular inner member 6 and an outer member or sleeve 4 which is relatively rotatably with respect to the member 6. Further constructional details may be obtained by reference to FIGS. 4–16. The preheating duct 27, which is formed in the interior of the inner member 6, receives the vapor at its upper end from the connection pipe 61. The holes 29, through which the saturated vapor moves from the preheating duct into the central area 19 of the yarn passage 10, are arranged in the upper end of the preheating chamber. This creates an area in the lower portion of the preheating duct in which the condensate, and also the inert gases and vapors which do not condensate at the given temperature and pressure conditions, accumulate by reason of the fact that such gases are heavier than the saturated vapor. The condensates, in particular the condensed water and inert gases, have a temperature which is below that of the saturated vapor. The preheating duct has an opening 106 at its lower end, which terminates in a separating chamber 107. Another opening 110 of the separating chamber 107 leads to the exterior and preferably to a condensate collector, which is not shown. Both openings 106 and 110 have a lower end, which are arranged in a common plane. A plate 111 rests on the bottom of the separating chamber 107, and is freely movable, but can be supported by a weak spring. It is important that the plate lies essentially parallel to the plane of the lower ends of the openings 106, 110, and is very closely spaced to the same. Spacers 112 may be provided on the underside of the plate, which insures that the static pressure of the separating chamber 107 is operative on the underside of the plate.

It will be understood that when the heating chamber is heated, condensates first collect in the lower portion of the duct 27. The condensates are transported through openings 106, separating chamber 107 and opening 110 to a condensate collector. Upon completion of the heating operation, only a small amount of the condensate accumulates, so that the saturated vapor starts to flow through the holes 106 and 110. As it does so, the saturated vapor flow contacts plate 111, so that it moves at a high velocity toward the opening 110. Due to this high velocity, the static pressure on the upper side of the plate drops, whereas the static pressure on the underside of the plate remains unchanged. This in turn results in the plate being pushed upwardly against the two openings 106 and 110, and it thereby closes the separating chamber 107, so that the static pressure is maintained therein. Since the opening 106 is smaller than the underside of the plate 111, and since the pressure at the opening 110 is essentially not higher than atmospheric pressure, the plate will rest stably in front of the opening 106.

The above described stable condition remains so long as the temperature in the separating chamber 107 is maintained. When however condensates or inert gases again start to collect in the lower area of the duct 27, the temperature drops. This also causes the pressure to drop in the separating chamber 107, which undergoes the same temperature fluctuations as the preheating duct due to the direct, heat conductive connection with the inner member 6. Due to a developing overpressure at opening 106, the plate first exposes opening 106, whereby the plate is canted relative to the opening 110. The pressure in the separating chamber 107 decreases, and the plate 111 drops to the bottom, so that now the condensate or the inert gases can completely escape. In the illustrated embodiment, the plate is adapted to move vertically against gravity. However, it is also possible to make the plate move horizontally or pivotally, and/or to replace the action of gravity with, for example, a spring.

The heating chamber of FIG. 24 generally corresponds to the heating chamber illustrated in FIGS. 7–9. In general, the chamber consists of a tubular inner member 6 having a yarn groove 10, with the groove 10 being narrow in the yarn inlet portion and the yarn outlet portion, and relatively wide in the central area 19. The inner member 6 is fixedly mounted between flange 3 and flange 113, and in its interior, the member 6 accommodates in its lower area a lower preheating duct 114, shown in dashed lines in FIG. 24. This lower heating duct is permanently connected with the vapor supply line 115, and it provides the advantage that the inner cylinder 6 is constantly heated in its central and lower portions.

In its upper portion, the inner member 6 includes a vapor supply duct 27 serving as a preheating duct, which communicates via hole 29 with the central area 19 of the yarn groove 10. On the rear side, the vapor supply duct 27 preferably communicates with a vapor pressure contact zone, which is formed between the outer member 4 and the inner member 6 between the sealing strips 35, and as also shown in FIGS. 8 and 9. This contact pressure zone, which is supplied during operation with the heated vapor under pressure, causes the outer member 4 and inner member 6 to be closely pressed against each other in the area of the yarn guide groove and sealing strips 25, so that the sealing strips 25 provide an adequately tight seal of the heating area. In this contact pressure zone between the sealing strips 35, it also results that the outer member 4 is heated, since it is in direct contact in this zone with the heated vapor.

The arrangement of the duct 27 and hole 29, i.e. where the vapor is supplied from top to bottom, provides that no condensate can accumulate in the duct 27. The heated vapor is supplied to the duct 27 via the connection line 28 and a three-way valve 116. Through this valve, the duct 27 is selectively supplied with the vapor or the vapor is released therefrom. When vapor is released, the contact pressure zone on the back side of the member 6 is simultaneously released, so that the outer member can readily be rotated relative to the inner member to the threading position shown in FIG. 25*a*. In this threading position, however, the vapor supply to the lower central preheating duct 114 is continued.

A drain pipe is indicated at 117, which is concentrically located in the lower preheating duct 114, and extends to its upper area. Downwardly, the drain pipe extends from the elbow of the supply line 115, and is closed by a narrow throttle 118. Some vapor, or condensate, or inert gas, can continuously escape through the throttle 118, so that the drain pipe 117 prevents inert, non-condensible gases from collecting in the area of the lower heating duct 114. The condensates accumulating at the bottom of the preheating duct can return in the line 115 to the vapor generator. It is also possible to arrange a condensate separator of, for example, the design as described in conjunction with FIG. 23, in the line 115.

In the drawings and specification, there has been set forth several preferred embodiments of the invention, and although specific terms are employed, they are used in a generic and descriptive sense only and not for purposes of limitation.

That which is claimed is:

1. A heating chamber for thermally processing more than one advancing yarn and which is characterized by stable temperature conditions which are substantially uneffected by a threading operation, and comprising an elongate first member composed of two longitudinally extending side plates disposed in a parallel, laterally spaced apart relationship, with said side plates having opposing faces, and with said opposing faces including respective lontigudinally directed shoulders which are laterally aligned so as to define in cross section an outer relatively wide channel and an inner relatively narrow channel between said two plates, an elongate second member disposed between said opposing faces of said side plates and extending along the longitudinal length thereof, said second member having opposite faces, with said opposite faces each having a longitudinally directed shoulder which opposes an associated shoulder of said first member, and such that the second member comprises in cross section an outer portion which is sized to be closely received within said outer channel of said first member and an inner portion which is sized to be closely received within said inner channel of said first member, means for heating said first and second members, and means for transversely moving said first and second members relative to each other and between an operative position wherein said cooperating pairs of shoulders are closely spaced apart to define a pair of yarn passages, and a threading position wherein said associated pairs of shoulders are widely spaced apart to facilitate yarn threading.

2. The heating chamber as defined in claim 1 wherein said means for heating said first and second members comprises duct means for introducing a hot vapor into each of said yarn passages when said members are in said operative position.

3. The heating chamber as defined in claim 2 wherein said duct means includes a passageway in at least one of said side plates which extends in a longitudinal direction, and secondary duct means extending from each of said passageways and through the interior of said second member to the vicinity of each of said shoulders thereof when said members are in the operative position.

4. The heating chamber as defined in claim 3 wherein said duct means includes a longitudinal passageway in each of said side plates, and further includes additional duct means extending transversely through said second member for interconnecting said passageways when said members are in the threading position.

5. The heating chamber as defined in claim 1 wherein said means for transversely moving said first and second members relative to each other includes means for relatively moving the members to an extent whereby the shoulders of said second member are separated from said side plates of said first member so as to permit a yarn to be laterally inserted into said outer channel on each side of said second member.

6. A heating chamber for thermally processing an advancing yarn and which is characterized by stable temperature conditions which are substantially uneffected by a thread-up operation, and comprising a first elongate plate having a generally flat surface, and a groove formed in said flat surface and extending along the longitudinal length thereof, a second elongate plate having a generally flat surface, means mounting said first and second members with said surfaces thereof in an overlying relationship and for movement along a direction which is generally parallel to the surfaces and transverse to the direction of said groove, and between an operative position wherein said surface of said second member overlies the groove in the surface of said first member to define a relatively narrow yarn passage and a threading position wherein said surface of said first member is positioned relative to the surface of said second member to define an enlarged opening to facilitate threading of a yarn, and means for heating said first and second members.

7. The heating chamber as defined in claim 6 wherein said means for heating said first and second members comprises duct means for introducing a hot vapor into said groove of said first member.

8. The heating chamber as defined in claim 7 wherein said duct means includes a passageway in said first member and extending in a direction parallel to said groove, and secondary duct means extending between said passageway and said groove.

9. The yarn heating chamber as defined in claim 7 further comprising a rigid housing substantially enclosing said first and second members and for resisting a separating force exerted by said heated vapor in said groove.

* * * * *